US006328004B1

(12) United States Patent
Rynhart

(10) Patent No.: US 6,328,004 B1
(45) Date of Patent: Dec. 11, 2001

(54) INTERNAL COMBUSTION ENGINES

(75) Inventor: Derek Rynhart, County Cork (IE)

(73) Assignee: Rynhart Research and Development Company Limited, Bantry (IE)

( * ) Notice: Subject to any disclaimer, the term of this patent is extended or adjusted under 35 U.S.C. 154(b) by 0 days.

(21) Appl. No.: 09/462,534

(22) PCT Filed: Jul. 8, 1998

(86) PCT No.: PCT/IE98/00058

§ 371 Date: Jan. 10, 2000

§ 102(e) Date: Jan. 10, 2000

(87) PCT Pub. No.: WO99/02829

PCT Pub. Date: Jan. 21, 1999

(30) Foreign Application Priority Data

Jul. 8, 1997 (IE) ..... S970508

(51) Int. Cl.[7] ..... F02B 33/04

(52) U.S. Cl. ..... 123/73 AF; 123/65 PE; 123/73 C; 123/73 S; 123/196 R; 184/6.8

(58) Field of Search ..... 123/65 B, 65 PE, 123/65 V, 68, 69 R, 70 R, 73 AE, 73 AF, 73 S, 73 C, 73 E, 196 R, 196 M, 192.2; 184/6.8

(56) References Cited

U.S. PATENT DOCUMENTS

| | | | | |
|---|---|---|---|---|
| 2,015,826 | | 10/1935 | Vincent | 123/56 |
| 2,404,833 | * | 7/1946 | Forster | 123/73 S |
| 4,137,020 | | 1/1979 | Ito et al. | 417/534 |
| 4,509,378 | * | 4/1985 | Brown | 123/192.2 |
| 5,186,137 | * | 2/1993 | Salzmann | 123/192.2 |

FOREIGN PATENT DOCUMENTS

| | | | | |
|---|---|---|---|---|
| 473434 | * | 3/1929 | (DE) | 123/73 S |
| 3725626 | | 2/1989 | (DE) . | |
| 69966 | | 10/1996 | (IE) . | |

OTHER PUBLICATIONS

PCT WO 87/05073 Aug. 1987.*

* cited by examiner

*Primary Examiner*—Noah P. Kamen
(74) *Attorney, Agent, or Firm*—Jacobson Holman, PLLC

(57) ABSTRACT

An internal combustion engine has a positive displacement supercharger which can be used with particular advantage in an underpumping two stroke engine which is in the form of a valved diaphragm which reciprocates in a housing to deliver positive pulses of air. The internal combustion engine also has an oiling system which includes injecting oil between the piston and cylinder walls at discrete time intervals and any excess oil is removed through galleries in the piston, connecting rod and main drive shaft preferably by a vacuum exerted on the galleries. Various other innovative features include a two part exhaust valve, generation of the vacuum by a positive displacement supercharger, a two-part cylinder head, use of inserts on moving parts to increase the efficiency of an underpumping engine and a specially constructed flywheel.

79 Claims, 16 Drawing Sheets

INTERNAL COMBUSTION ENGINES

INTRODUCTION

The present invention relates to internal combustion engines.

Diesel fuel is environmentally much more acceptable than petrol and two stroke engines by their very nature are more advantageous than four stroke engines since theoretically for identical speeds a two stroke engine should produce twice the output of a four stroke engine. This is obviously not the case for many reasons and further two stroke engines are environmentally unacceptable in that they are a major source of pollution, as It is estimated that somewhat of the order of 40% of the oil/fuel mix which is used to lubricate the engine is delivered unburnt to exhaust. Increasingly stringent exhaust emission regulations in many countries will in effect prohibit the use of conventional two stroke engines.

A further problem with many engines is that they operate in corrosive or otherwise unsuitable environments. It is appreciated that compression ignition engines are more efficient than other types of internal combustion engines particularly in such situations. They are also particularly suitable for continuous running. One of the problems with the use of compression ignition engines for low horsepower outputs is that they are generally extremely heavy. For example, it is not unknown for a conventional compression ignition engine producing somewhat of the order of 6 horsepower to have a weight in excess of 136 kg (300 lbs). Such an engine is generally speaking of limited use except for stationary applications. Further, because it is so heavy it is relatively expensive to produce, uses a considerable amount of material and is difficult to transport. Thus, diesel engines by their nature are unsuitable for many uses such as relatively small machines, for example, lawn mowers, marine outboard engines, portable generators and hand tools.

In summary, there are considerable advantages in having a slow revving compression ignition engine if such a slow revving compression ignition engine could be relatively lighter than heretofore.

Further, it is advantageous to have an efficient lubrication-system, particularly for two stroke engines which does not suffer from the disadvantages of the present system using a combination of oil and fuel which is an inefficient way of carrying out the lubrication, doesn't operate during idling conditions with the throttle closed and further is a major source of pollution.

Ideally any such internal combustion engine if its weight is to be reduced must incorporate an efficient air charging system and further should, if possible, have an efficient supercharger. Unfortunately conventional superchargers are expensive and relatively wasteful of power input. Further in many instances they require lubrication which leads to added pollution. It has long been appreciated that air charging by under-pumping or, as it is often referred to as crankcase scavenging, is efficient, but heretofore because of the general size of sumps, etc. has not been particularly efficient.

It has further been long appreciated that the use of an injector such as described and claimed in Irish Patent No. 69,966 hereinafter the-Rynhart pneumatic injector so named in honour of its inventor is a very efficient way of delivering diesel fuel to a compression ignition engine and is particularly useful with engines of low power output as the weight saving in the pneumatic injector compared to a conventional pump and injector system is significant. Therefore there is a need for an engine which will efficiently use the Rynhart injector.

One of the problems with the use of a supercharger in a compression ignition engine and in particular in a compression ignition engine which utilises a pneumatic injector, such as the Rynhart pneumatic injector, is the need to control the compression pressure in the engine accurately for efficient combustion.

It has been appreciated that there are problems in having flywheels of conventional construction in that when piston seizure occurs, considerable damage can be done with the flywheel shearing and causing damage.

Further, it is known that one of the major problems with all internal combustion engines is the use of hydrostatic bearings which add to the cost of the engine and which require high pressurised lubrication systems. Anything that could obviate the need to use such hydrostatic bearings and for example allow the use of frictionless bearings would be advantageous.

OBJECTS OF INVENTION

The present invention is directed towards providing an internal combustion engine that will overcome some of these drawbacks in the present constructions of engines and is particularly directed towards providing an efficient compression ignition two stroke engine that will produce more power output than a much higher revving four stroke engine of the same weight.

SUMMARY OF INVENTION

The invention provides an internal combustion engine with under piston charging and a positive displacement supercharger outside the air charging chamber formed underneath the piston in the crankcase of the engine. The positive displacement supercharger comprises a supercharger housing mounting a diaphragm in the housing which diaphragm divides the housing into a front delivery chamber communicating via an outlet with an air inlet duct in the casing forming the air charging chamber and a rear chamber open to the atmosphere. The diaphragm can be moved across the chamber towards the outlet in a working stroke delivering air into the engine and away from the outlet in a return stroke drawing air into the housing. The diaphragm is supported on a piston formed from a plate having a hole which is slidably mounted on the crankshaft. A one-way valve is mounted in plate and a cam assembly is provided for reciprocating the piston on the crankshaft. The cam assembly comprises a cam connected to the piston and a rigidly mounted cam follower. A timed delivery valve is provided between the supercharger and the charging chamber in the air inlet duct between the supercharger and the charging chamber. The timed delivery valve is opened at approximately BDC and closed after the air transfer port in the cylinder bore which communicates with the air charging chamber of the under-pumped IC engine is shut off.

The invention provides various inserts of structured foam plastics material such as polyurethane to reduce the volume of the charging chamber.

In one embodiment, the invention provides a generally cylindrical bob weight for the connecting rod of the engine filled with inserts to again reduce the volume of the charging chamber.

Further, the invention provides a lubricant distribution assembly which comprises means for delivery of oil from the oil storage sump of the engine and means for injecting oil between the piston skirt and cylinder wall at discrete time intervals. Further, there is provided scavenging means for removing oil from the piston skirt and cylinder wall and returning excess oil to the sump through lubricant galleries comprising enclosed passageways. In this way, the excess oil is not burnt off in the engine but is removed from the piston skirt and cylinder wall. The galleries communicate through the piston and connecting rod to the sump. Oil is injected between the piston skirt and the cylinder wall by an oil pump which delivers oil from the oil storage sump out through the cylinder wall which then directs the oil against the piston. There can be a number of circumferentially spaced holes around the cylinder wall for the injection of oil onto the piston. The piston will generally have a circumferential groove in the piston skirt to receive the oil. An additional elongate axially arranged groove in the piston skirt may communicate with the hole in the cylinder wall and with the circumferential groove in the piston skirt.

It will be appreciated that as the piston reciprocates, the axially arranged groove will at certain times coincide with the hole in the cylinder wall.

Ideally, the circumferential groove in the piston incorporates an oil scavenging ring and is preferably adjacent the bottom of the piston skirt.

Galleries comprising enclosed passageways which communicate with the circumferential groove for scavenging can be connected to various engine bearings for lubrication.

Ideally, the scavenging means comprises means for causing a vacuum to be exerted in the gallery and preferably the scavenging means is formed by the supercharger itself.

In one embodiment of the invention, a cam assembly is provided for the supercharger and comprises a crankshaft extension housing which has a rear oil chamber remote from the diaphragm and a front end chamber closer to the diaphragm. A rotatable swash plate is mounted on the crankshaft and is connected to the cam and reciprocates within the rear oil chamber. A one-way valve is mounted on the swash plate and there is return piping connecting the front oil chamber to the oil storage sump and feed piping connecting the oil storage sump to the rear oil chamber. A non-return valve is mounted in the feed piping. A lubricating gallery is mounted in the crankshaft and has an inlet in the crankshaft between where the return piping connects to the front oil chamber and where the feed piping connects to the rear oil chamber. It will be appreciated that as the swash plate reciprocates, the rear oil chamber gets larger and smaller. The piping are so connected that as the swash plate reciprocates in the rear oil chamber towards the front oil chamber with the cam, it generates a vacuum and first exposes the non-return valve in the feed piping to the sump to draw oil into the rear oil chamber and as the swash plate progresses further, the vacuum builds up in the rear oil chamber until the inlet to the gallery is exposed and a vacuum is exerted on the galleries to draw oil into the rear oil chamber and on the swash plate reversing oil is delivered through the one way valve in the swash plate to the front oil chamber for lubrication of the cam and return to the sump.

Further, the invention provides a two part exhaust valve comprising an outer exhaust port seating portion and a main inner portion, the outer and inner portions being mutually engagable to retract away from the exhaust port and this valve may be a two part telescopic exhaust valve comprising an exhaust port seating mushroom valve head mounted on a valve stem and having a rearwardly extending tubular portion nesting and slidable within an enclosed tubular stationary bushed guide through which the valve stem projects. The valve may be operated by a valve stem engaging one end of a valve rocker arm, the other end of which can be spring urged into engagement with a cam on the crankshaft.

In one embodiment of the invention, the cylinder head is a two-part cylinder head comprising an inner portion housed within a concentric outer portion, the portions forming a hollow circumferential chamber therebetween and a sound absorption material in the chamber and a sound absorption material in the chamber which is preferably additionally an efficient heat transfer material. The engine may have a flywheel driven from the crankshaft at a speed twice that of the crankshaft and is preferably offset from the crankshaft for safety.

Further, the invention provides an internal combustion engine of conventional type with various engine bearings such as, for example, crankshaft, little and big end bearings, and so on.

The invention provides a lubrication assembly which comprises means for delivery of oil from the normal oil storage sump, then injecting that oil between the piston skirt and cylinder wall at discrete time intervals and then further includes, scavenging means for removing oil from the piston and cylinder wall and returning excess oil to the sump through galleries. Ideally, these galleries, as mentioned already with reference to the other embodiment, communicate through the piston and connecting rod to the sump. The various features previously described in relation to the lubrication distribution assembly are incorporated in this engine. The engine may ideally be a two-stroke compression ignition engine and is very often, a single cylinder engine.

Further, the invention provides a positive displacement supercharger having a working stroke for delivering air to the engine combustion chamber and a return stroke drawing air through an air inlet into the supercharger. The supercharger comprises a supercharger housing and a diaphragm dividing the housing into a front delivery chamber communicating via an outlet with the air inlet duct and a rear chamber open to the atmosphere. The supercharger has means for moving the diaphragm across the chamber towards the outlet in a working stroke and away from the outlet in a return stroke drawing air into the housing. There is a one-way valve mounted on the diaphragm to allow passage of air between the front and rear chambers during the return stroke of the diaphragm away from the outlet.

In one embodiment of the invention, the supercharger feeds the engine directly through an accumulator chamber having an outlet valve, which outlet valve may be pressure controlled or synchronised with the engine cycle.

BRIEF DESCRIPTION OF THE DRAWINGS

The invention will be more clearly understood from the following description of some embodiments thereof given by way of example only with reference to the accompanying drawings in which.

DETAILED DESCRIPTION OF THE PREFERRED EMBODIMENTS

Figure 1:
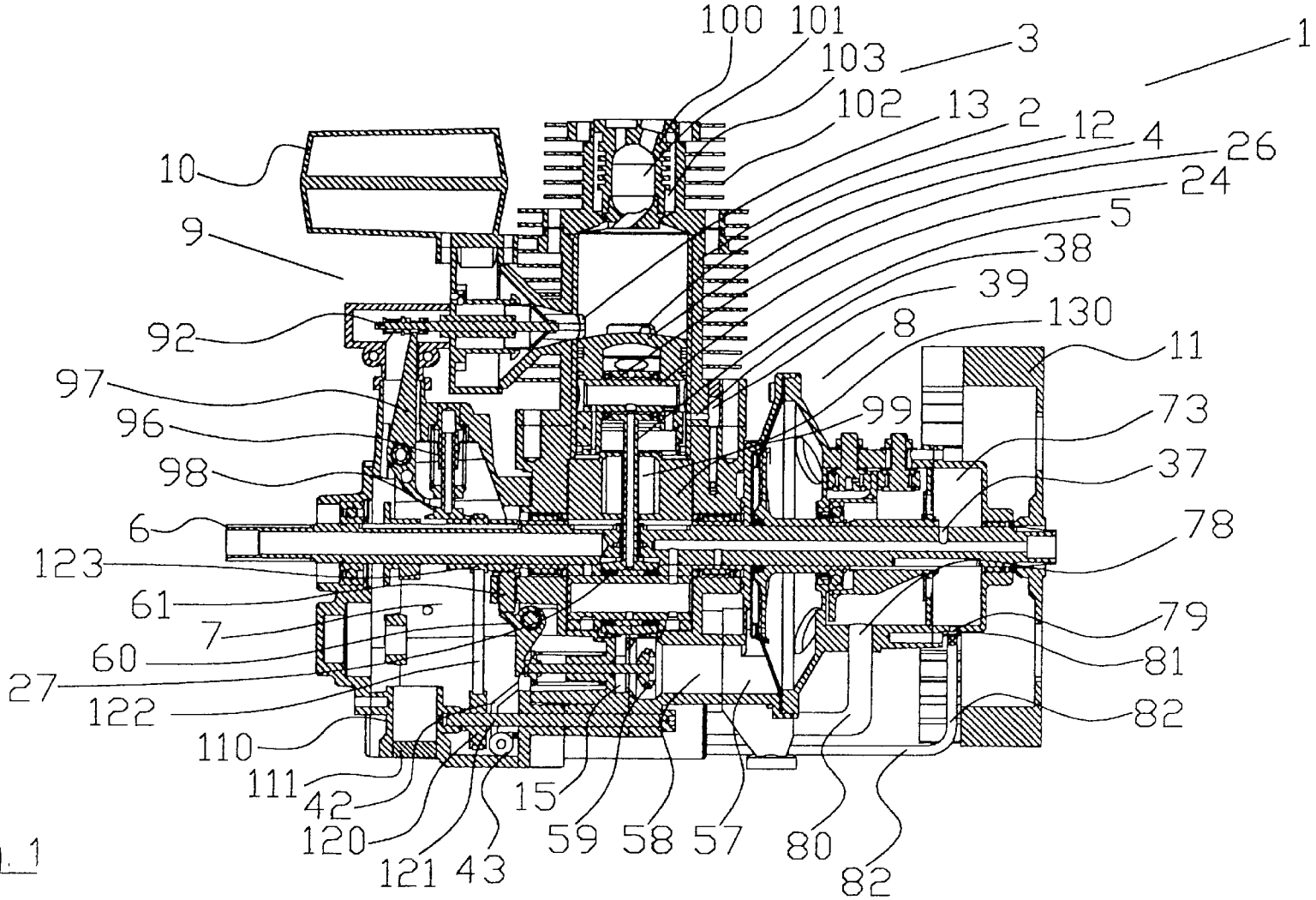
FIG. 1 is a sectional view of a two stroke compression ignition engine incorporating the present invention.

Referring to the drawings and initially to FIGS. 1 to 13 thereof, there is provided a two stroke compression ignition engine indicated generally by the reference numeral 1, the main parts of the engine are a cylinder 2 which is essentially of the indirect type having a cylinder head indicated generally by the reference numeral 3 on which would normally be mounted, although it is not shown, a Rynhart injector. The cylinder 2 houses a piston 4 connected by a connecting rod 5 to a crankshaft 6 which is housed partially within a sump 7. It will be noted that the connecting rod 5 is not mounted in the sump 7 but isolated therefrom. The engine 1 includes a supercharger indicated generally by the reference numeral 8, an exhaust valve assembly indicated generally by the reference numeral 9 and an muffler 10 are provided as is a flywheel 11. Air transfer ports 12 and an exhaust port 13 in which the exhaust valve assembly 9 sits are provided. A crankcase 14 is separate from the sump 7 and forms an air charging chamber 15 below the piston 4. Because the piston is illustrated at BDC, little of the chamber 15 is shown in FIG. 1.

It will be apparent from reading this specification that there are many novel and innovative features to this engine, many of which are applicable to a wide range of internal combustion engines and not just to an under-pumping, supercharged, two stroke compression ignition engine as described in this embodiment. Further, it will be appreciated that the engine incorporates a large number of parts that are conventional in their construction and these parts are only described insofar as they are necessary for the understanding of the invention, applied to the engine and for the innovative and novel features of the invention. Accordingly, in some of the drawings, some of the reference numerals have been omitted for clarity and some of the details shown in other drawings.

Figure 5:
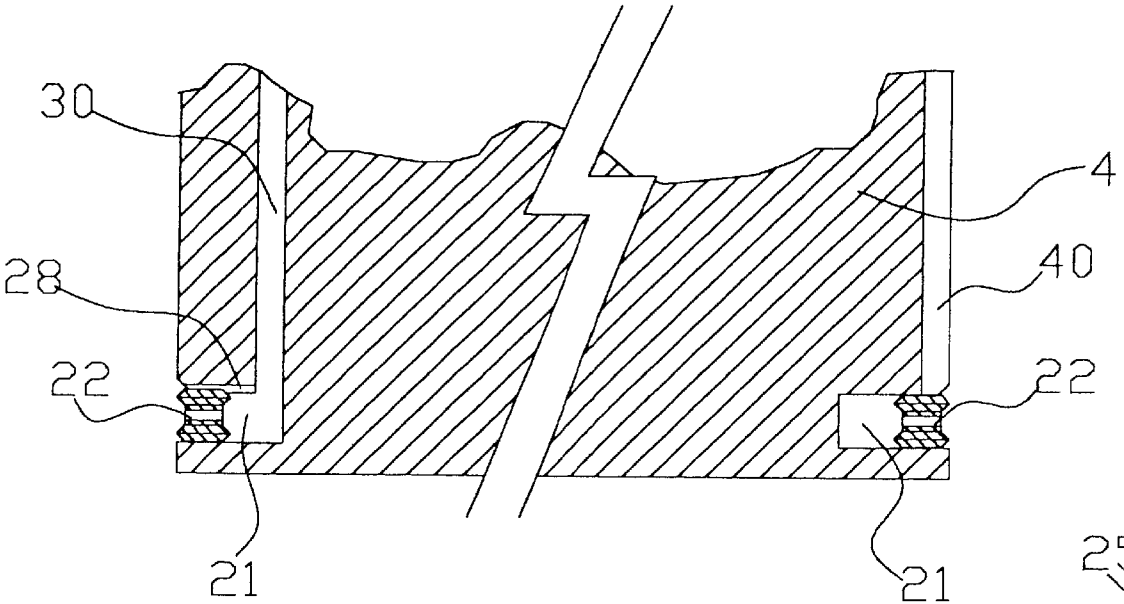
FIG. 5 is an enlarged sectional view of portion of the piston of FIGS. 3 and 4.

Referring now to FIGS. 2 to 5, the piston 4 has piston circumferential ring grooves 20 and a lower groove 21. Many of the details of the piston 4 can be seen in FIGS. 1 and 2 but many of the parts are only identified in FIGS. 3 to 5. A scraper ring 22 only illustrated in FIG. 5 is housed in the lower groove 21 in the piston skirt 4*a*. A plurality of circumferentially arranged bleed grooves 28 are formed in the upper surface of the groove 21 to provide additional oil passageways or galleries across the top of the scraper ring 22. The piston 4 has gudgeon holes 23 for a hollow gudgeon pin 24. Both ends of the gudgeon holes 23 are blanked off by plugs 25. The connecting rod 5 is mounted in the piston 4 by a little end bearing 26 and on the crankshaft 6 by a big end bearing 27, both of which are needle roller bearings. The piston 4 has a vertically arranged gallery 30 which communicates between the gudgeon pin 24 and the groove 21. The gudgeon pin 24 in turn communicates by a further gallery 31 with the little end bearing 26 and with a gallery 32 in the connecting rod 5, with the big end bearing 27 and then galleries 33 and 34 with a gallery 35 in the crankshaft 6. The big end is also sealed with end plugs which seal and also reduce volume. Further galleries 36 and 37 are formed in the crankshaft 6, the function of which will be described later. Some of the galleries are simply holes and others, as can be seen, are through bores forming enclosed passageways. An elongated axially arranged groove 40 is formed in the piston 4 and communicates with the circumferential groove 21 and, as can be seen from FIG. 1, communicates with further galleries 38 and 39 in the cylinder 2 which in turn communicates through a pipe 42 with an oil pump 43 mounted in the sump 7. Only a portion of the pipe 42 is visible in FIG. 1. It will be seen therefore that there is a clear passageway between the pump 43 and the circumferential groove 21 and then through the other galleries with the interior of the crankshaft 6 and certain other of the bearings.

The space beneath the piston 4 which forms the air charging chamber 15 is connected by air transfer porting (not shown) to the air transfer ports 12 in the cylinder.

Referring to FIGS. 6 to 11, the supercharger 8 comprises a housing having a front casing 50 and a rear casing 51 sandwiching therebetween a diaphragm 52 carried on a piston 53 which effectively divides the housing into a front delivery chamber 54 and a rear chamber 55. It will be appreciated that the front delivery chamber 54 is shown at its smallest size in FIG. 1. the front casing 50 has an outlet 57 (see FIGS. 1 and 7).

Figure 10:
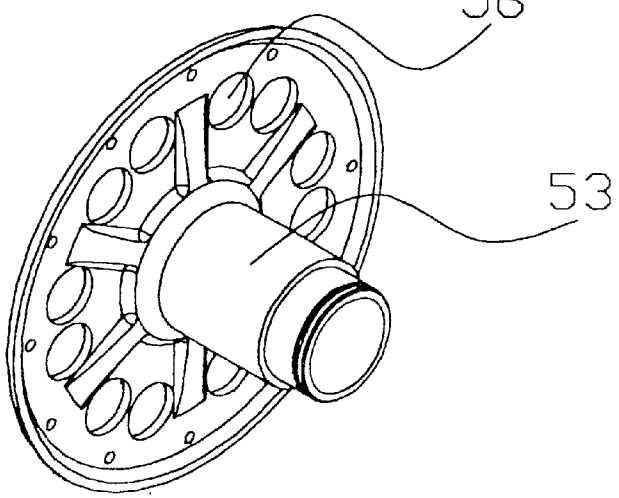
FIG. 10 is a perspective view of a piston forming part of the supercharger.
Figure 11:
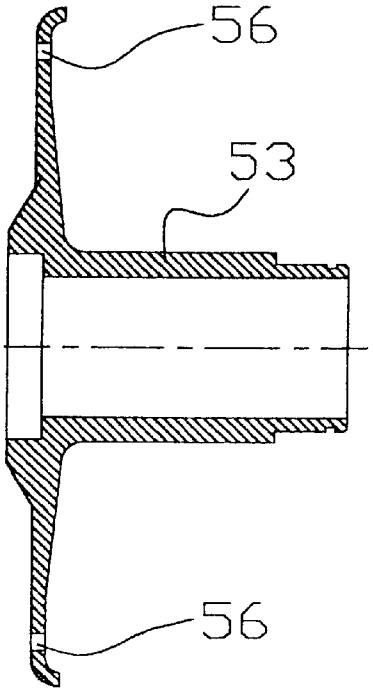
FIG. 11 is a sectional view of the piston of FIG. 10.
Figure 9:
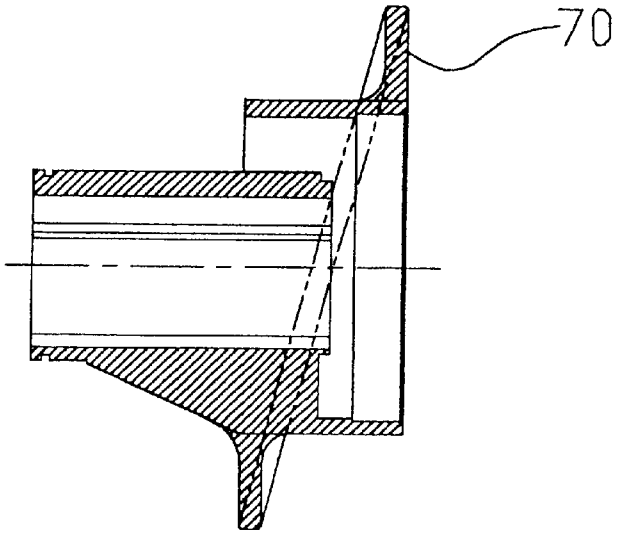
FIG. 9 is a sectional view of a cylindrical cam forming part of the supercharger assembly.

Referring now to FIGS. 10 and 11, it will be noted that the piston 53 has a plurality of holes 56 which incorporate flap valves 52(*a*) formed by an extension of the diaphragm 52. The front casing 50 and thus the front delivery chamber 54 communicates by the outlet 57 with a duct 58 in the crankcase 14 through a valve 59 (see FIGS. 1 and 7) with the air charging chamber 15. The valve 59 is operated by a rocker arm 60 and a cam 61 keyed to the crankshaft 6.

Figure 6:
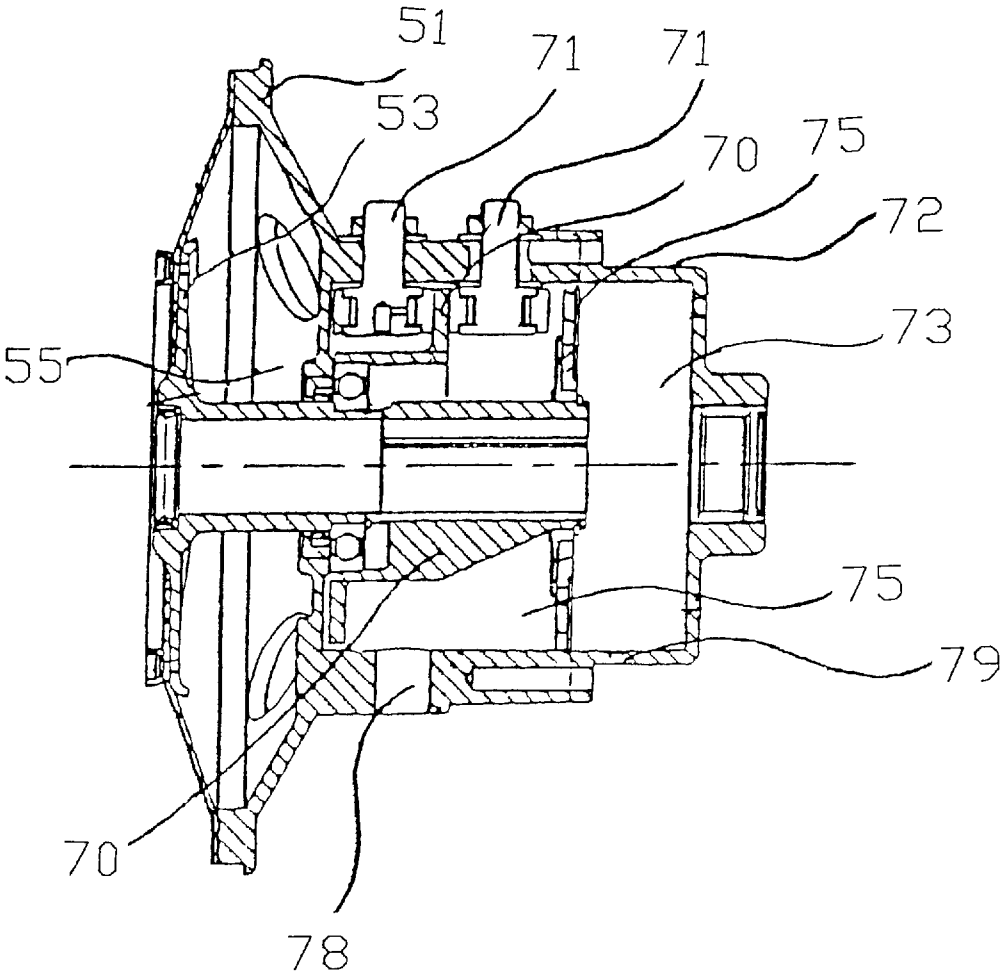
FIG. 6 is a sectional view through a supercharger assembly forming part of the invention with one casing removed.
Figure 7:
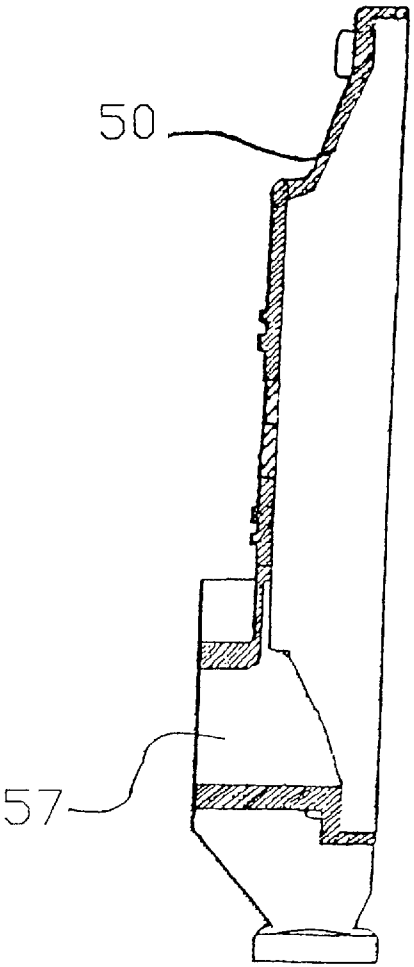
FIG. 7 is a sectional view through the casing not shown in FIG. 6.
Figure 8:
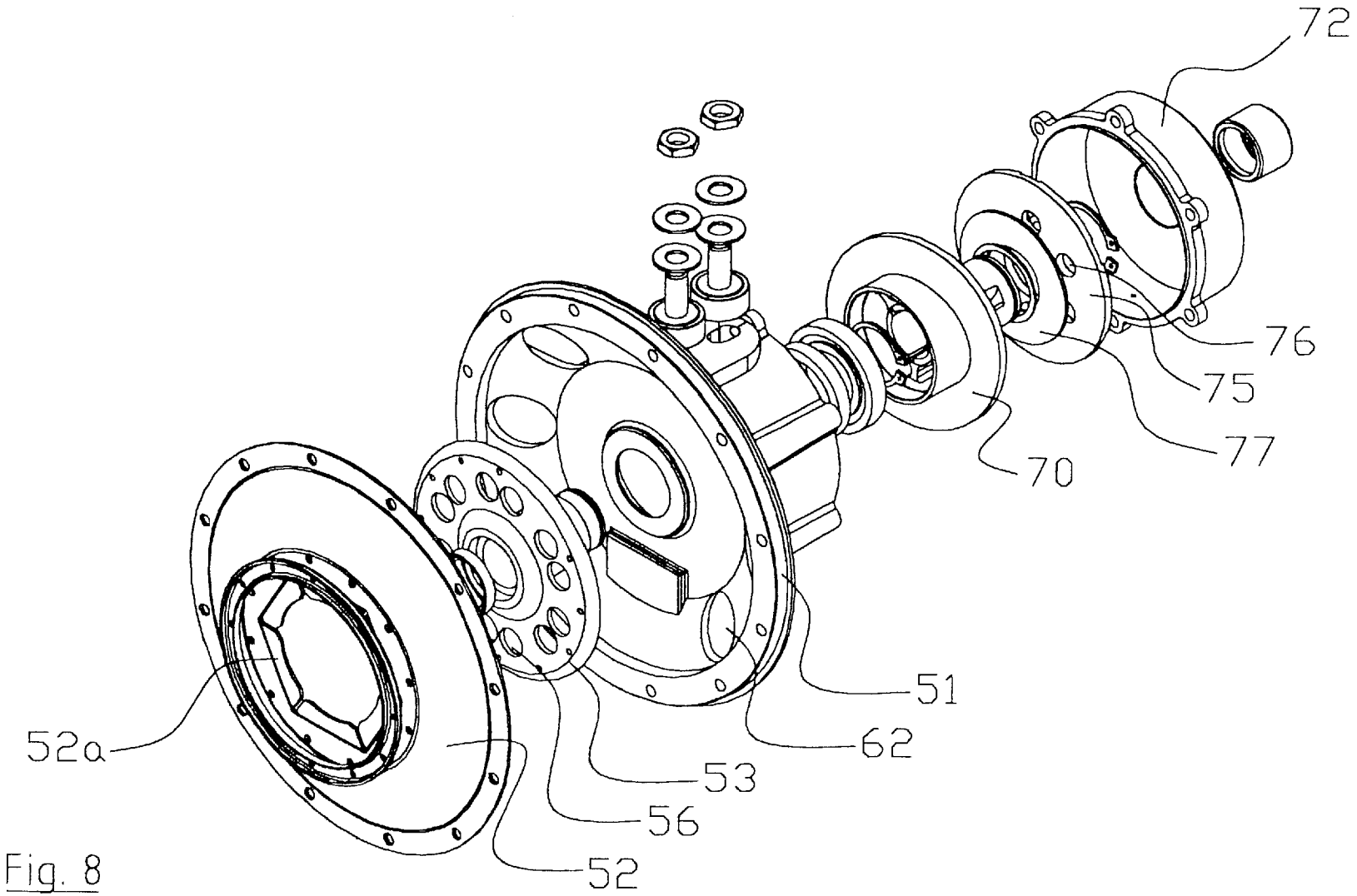
FIG. 8 is an exploded view of the supercharger assembly as illustrated in FIG. 6.

Referring specifically to FIGS. 6 and 8, the rear casing 51 has holes 62 which allow the rear chamber 55 to communicate directly with atmosphere. Mounted on the rear of the piston 53 is a cylindrical cam 70 mounted between a pair of cam followers 71. A crankshaft extension housing 72 is bolted onto the rear casing 51 and has a rear oil chamber 73 and a front oil chamber 74 divided by a swash plate 75 mounted on the cam 70. The swash plate 75 has holes 76 covered by a flap valve 77 clearly shown in FIG. 8. The crankshaft extension housing 72 has an outlet 78 and an inley 79.

Referring now to FIG. 1, the outlet 78 is connected by return piping 80 to the sump 7 and the inlet 79 is connected through a non-return valve 81 by feed piping 82 to the sump 7. It will be noted that in the position illustrated in FIG. 1, the gallery 37 communicates with the rear oil chamber 73.

Figure 12:
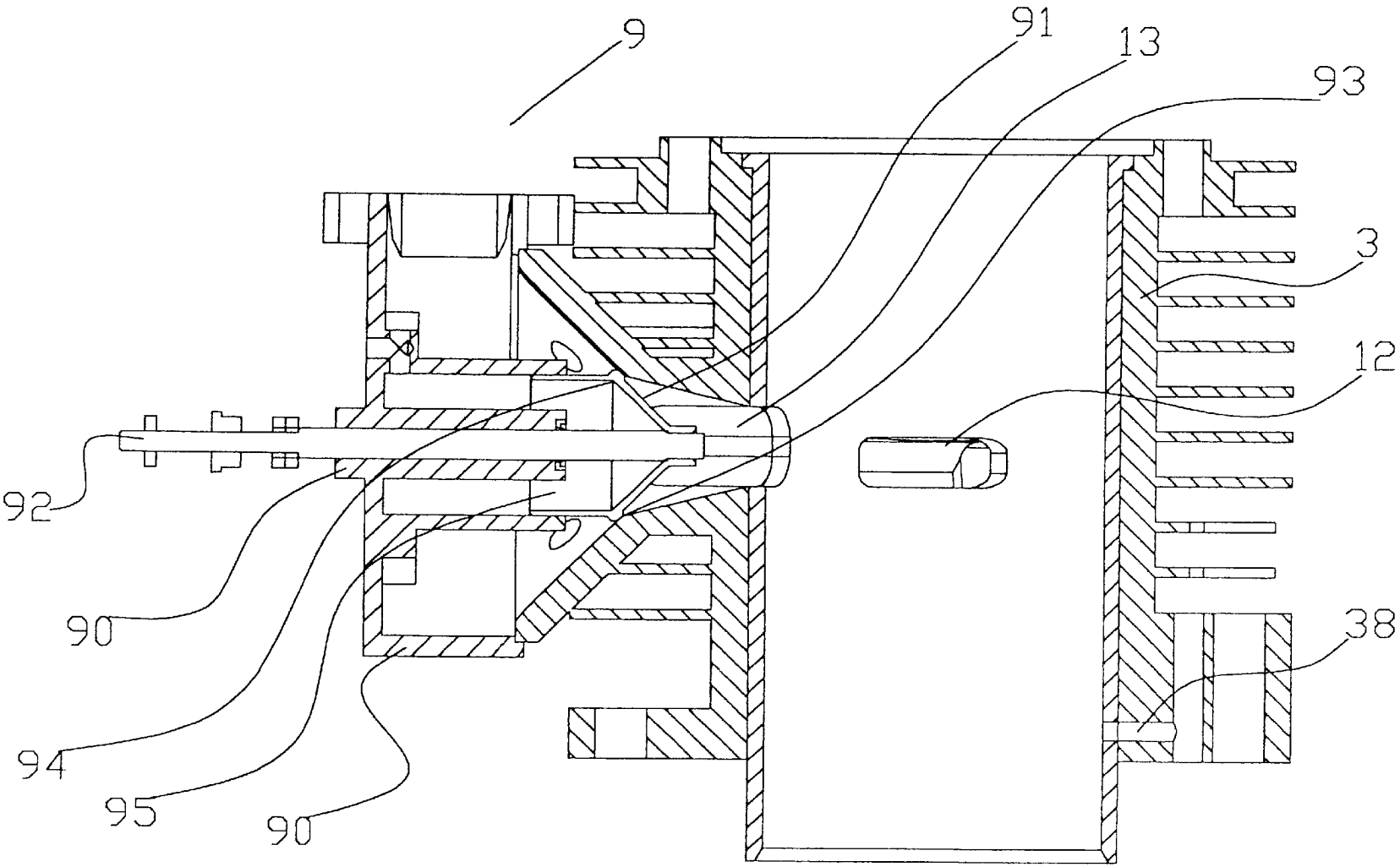
FIG. 12 is an enlarged sectional view of a two part exhaust valve and portion of the cylinder block.

Referring now specifically to FIGS. 1 and 12, the exhaust valve 9 is shown mounted in the conventional exhaust port 13 and comprises an inner valve guide flange 90 housing a tubular valve head 91 on a valve spindle 92. The valve head 91 has a pair of annular sealing surfaces, namely, a forward sealing surface 93 for mating against the exhaust port 13 and a rearward sealing surface 94 for mating against the inner valve guide flange 90. There is thus a space formed between the inner valve guide flange 90 and the valve head 91 which space is identified by the reference numeral 95 and may, in certain embodiments, be connected to the supercharger. A spring 96 (see FIG. 1) on the spindle 92 biases the valve head 91 to seat against the exhaust port 13. The valve spindle 92 is operated by a sliding shoe rocker arm 97 which engages a cam 98 on the crankshaft 6.

Figure 2:
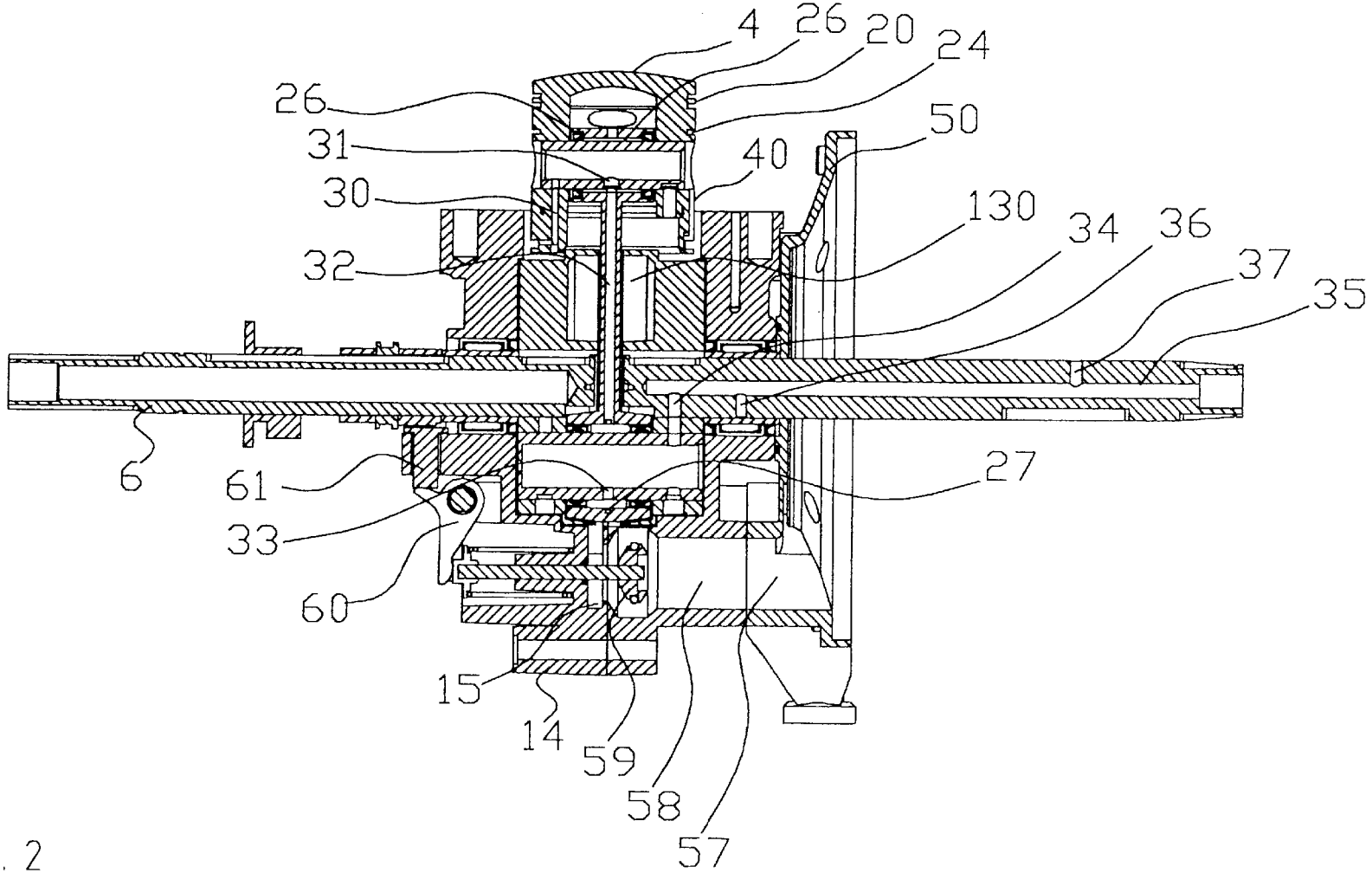
FIG. 2 is a sectional view of the crankcase assembly of the engine.
Figure 4:
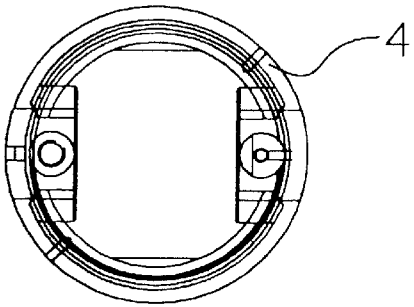
FIG. 4 is an underneath plan view of the piston.
Figure 3:
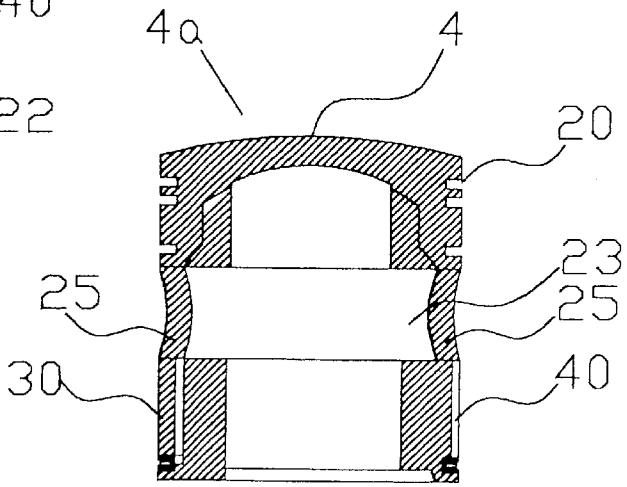
FIG. 3 is a detailed sectional view through the piston.
Figure 13:
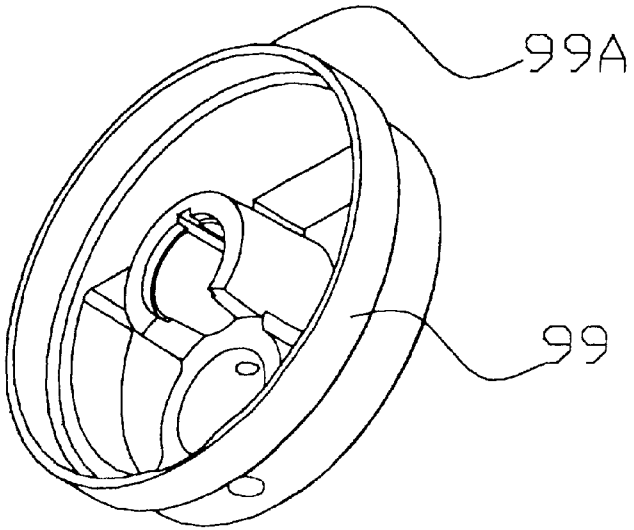
FIG. 13 is a perspective view of a bob weight used in the engine.
Figure 14:
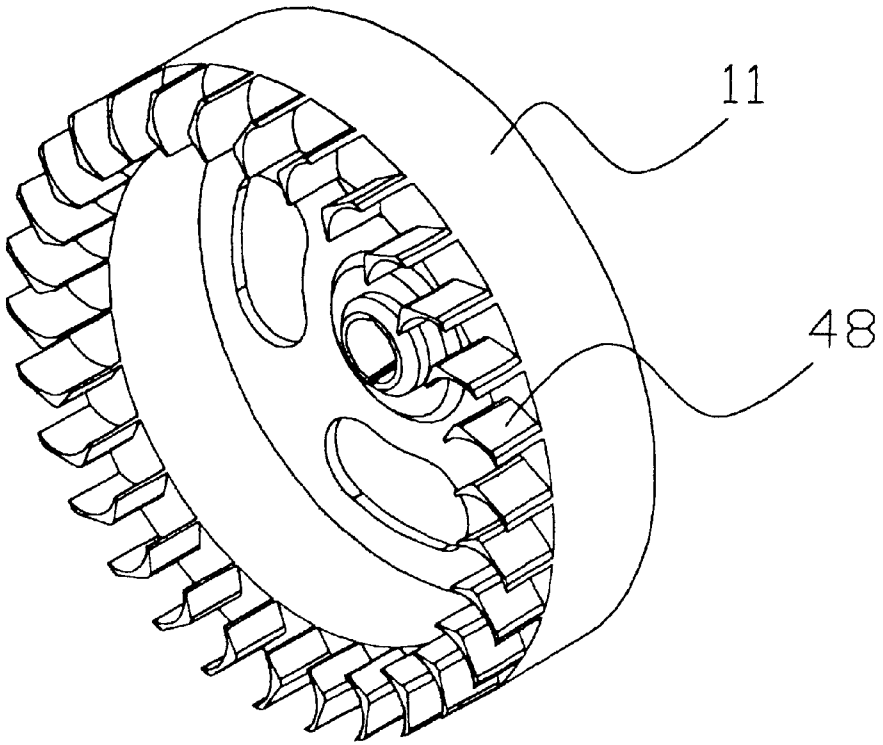
FIG. 14 is a perspective view of the flywheel.
Figure 15A:
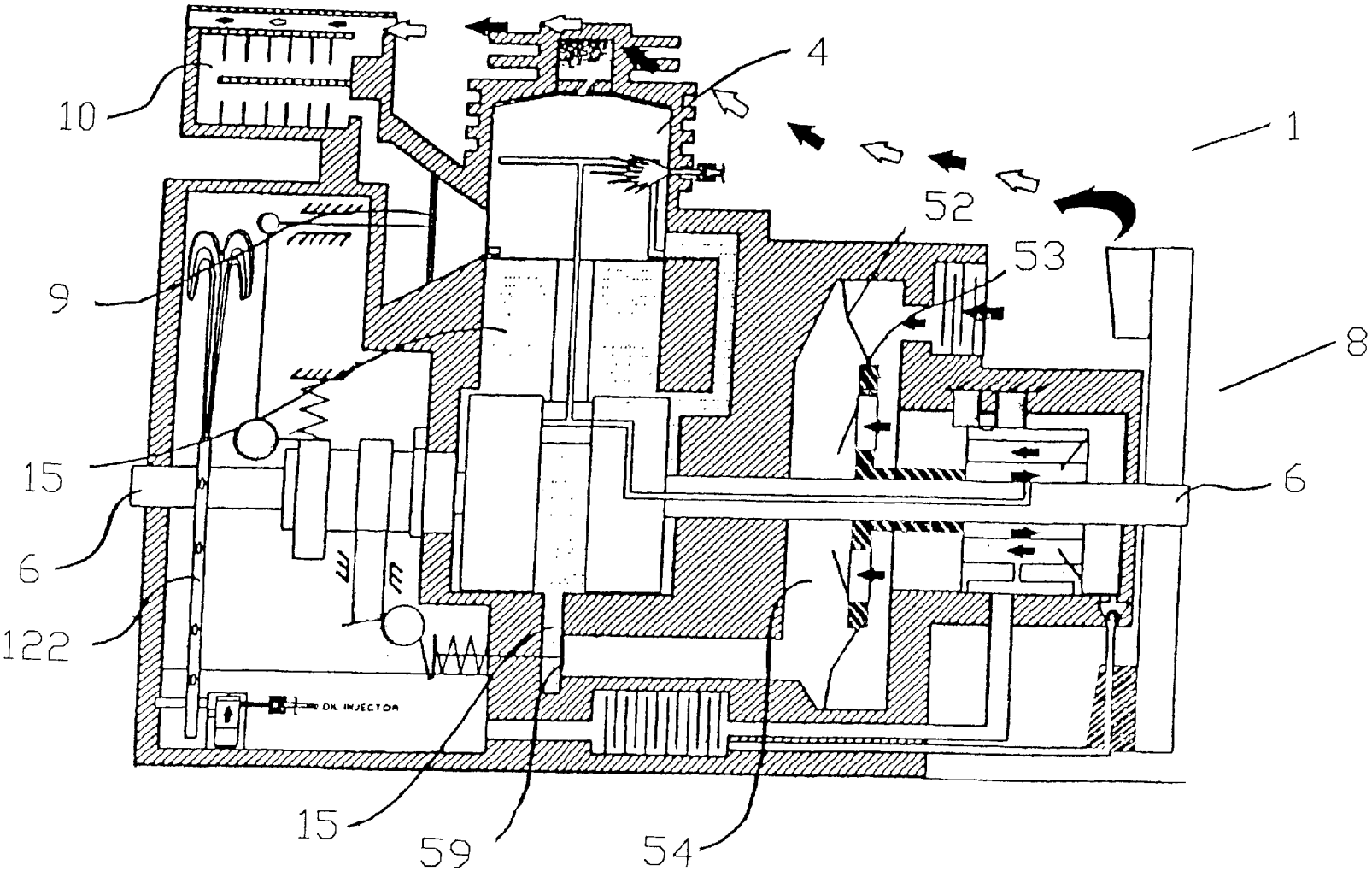
FIG. 15(*a*) to (*h*) are diagrammatic representations of the operation of the engine.
Figure 15B:
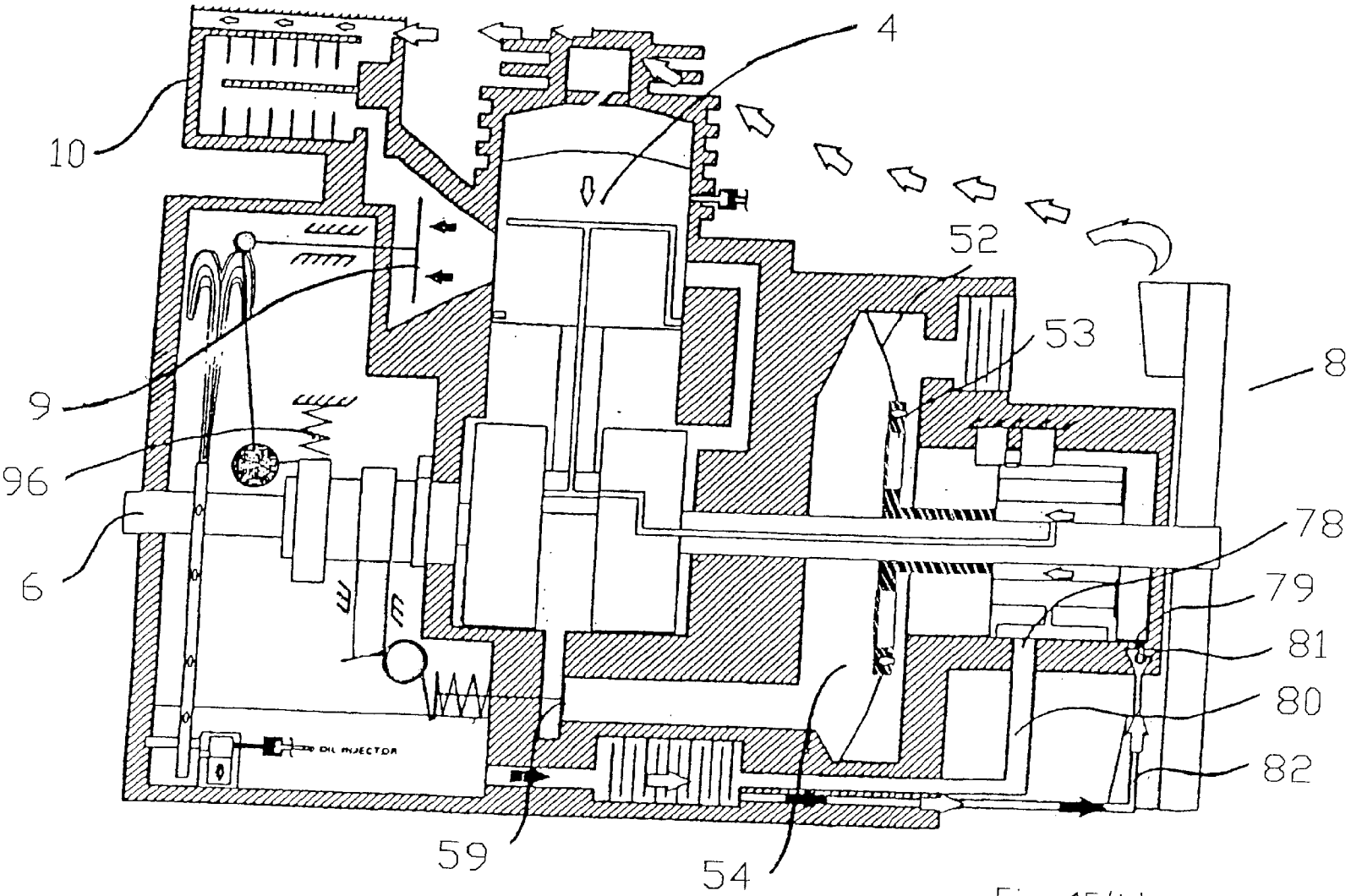
Figure 15C:
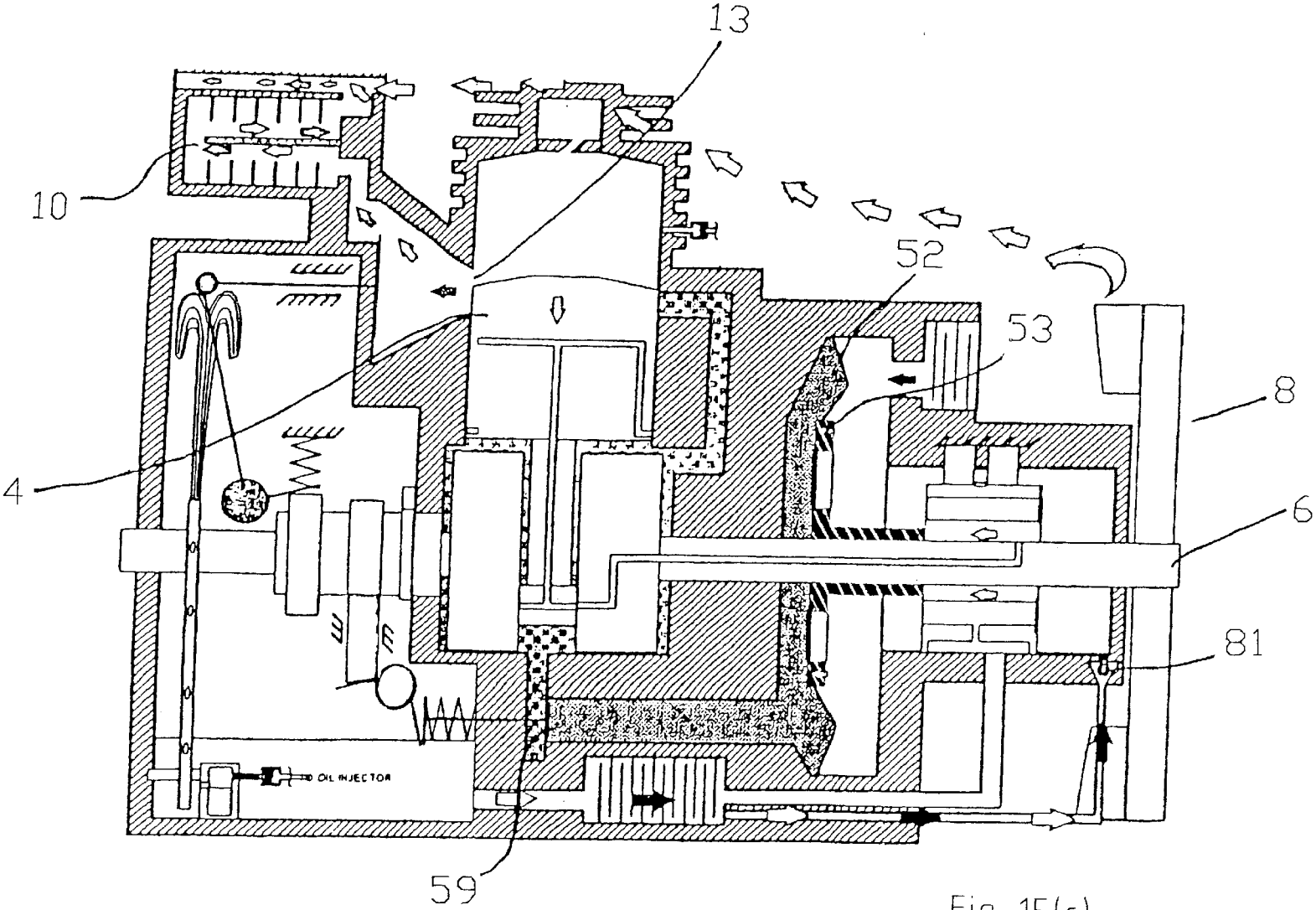
Figure 15D:
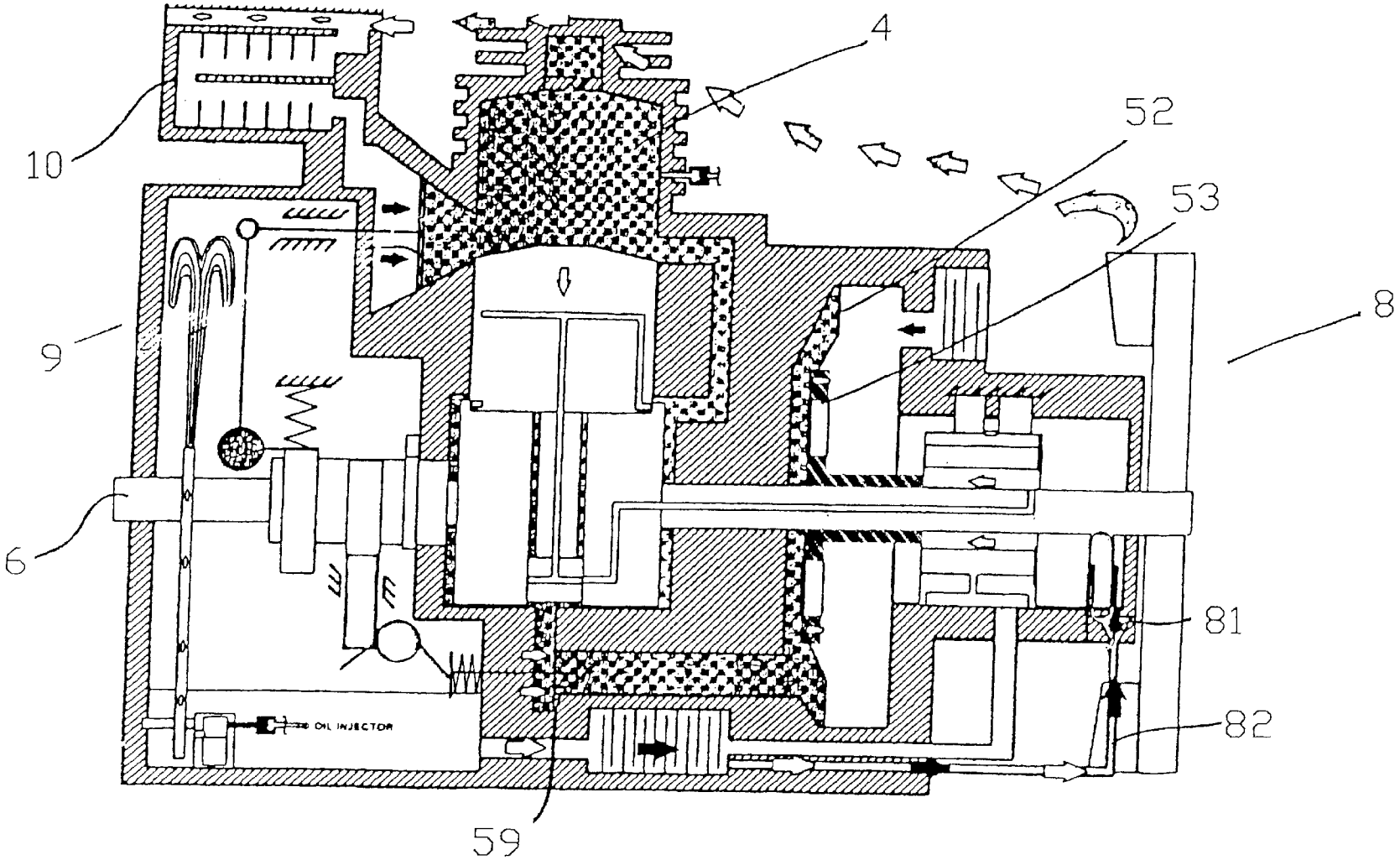
Figure 15E:
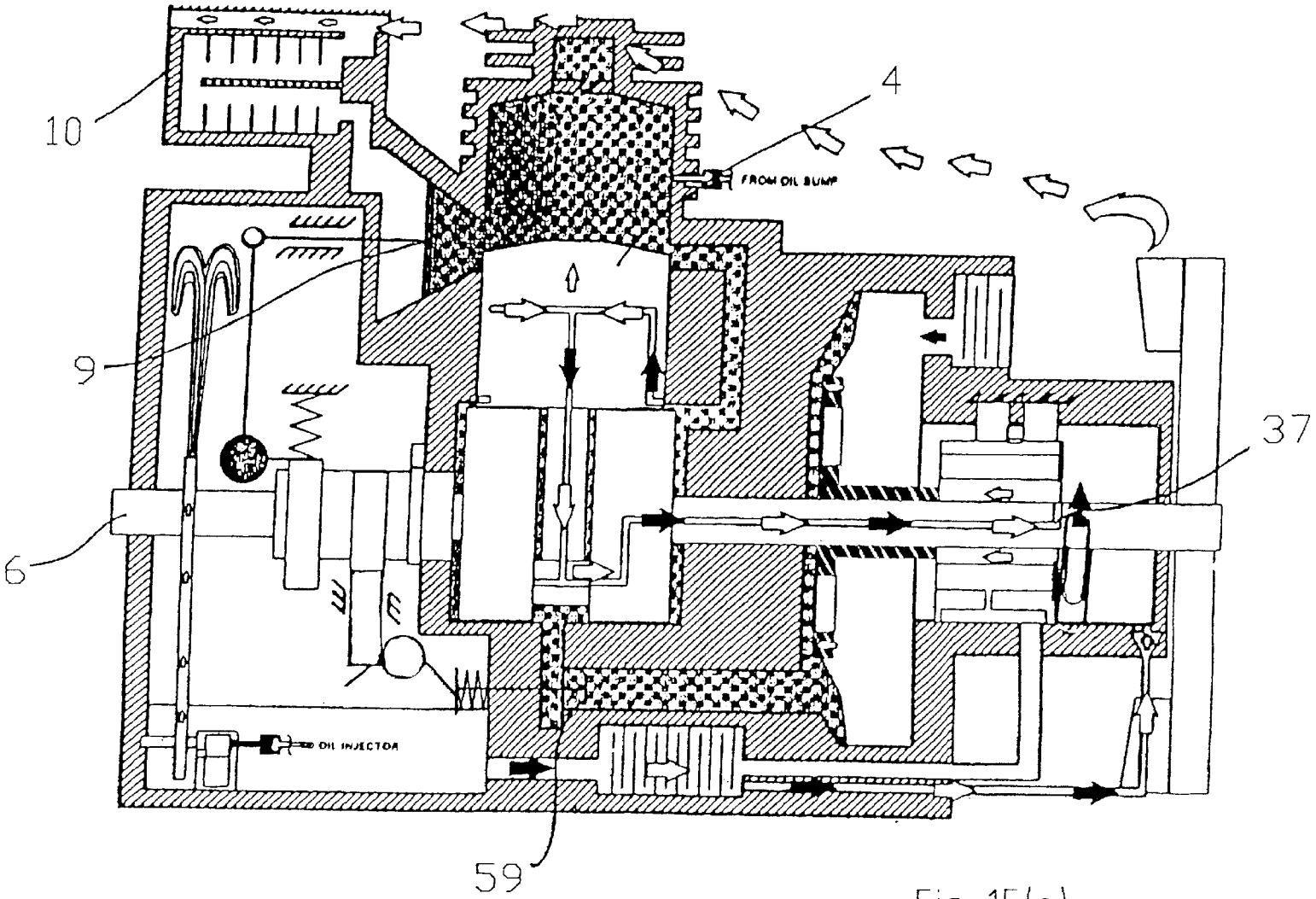
Figure 15F:
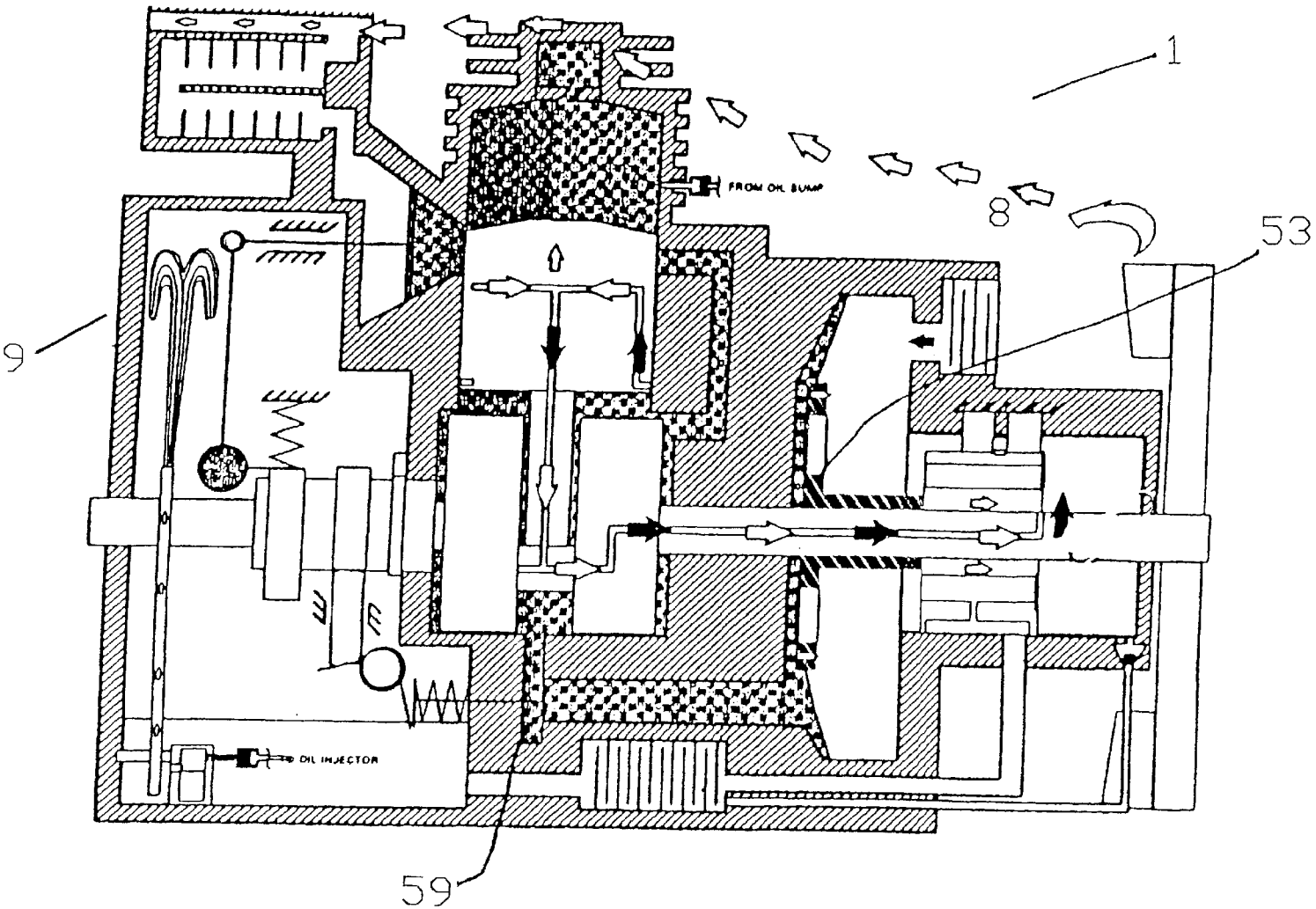
Figure 15G:
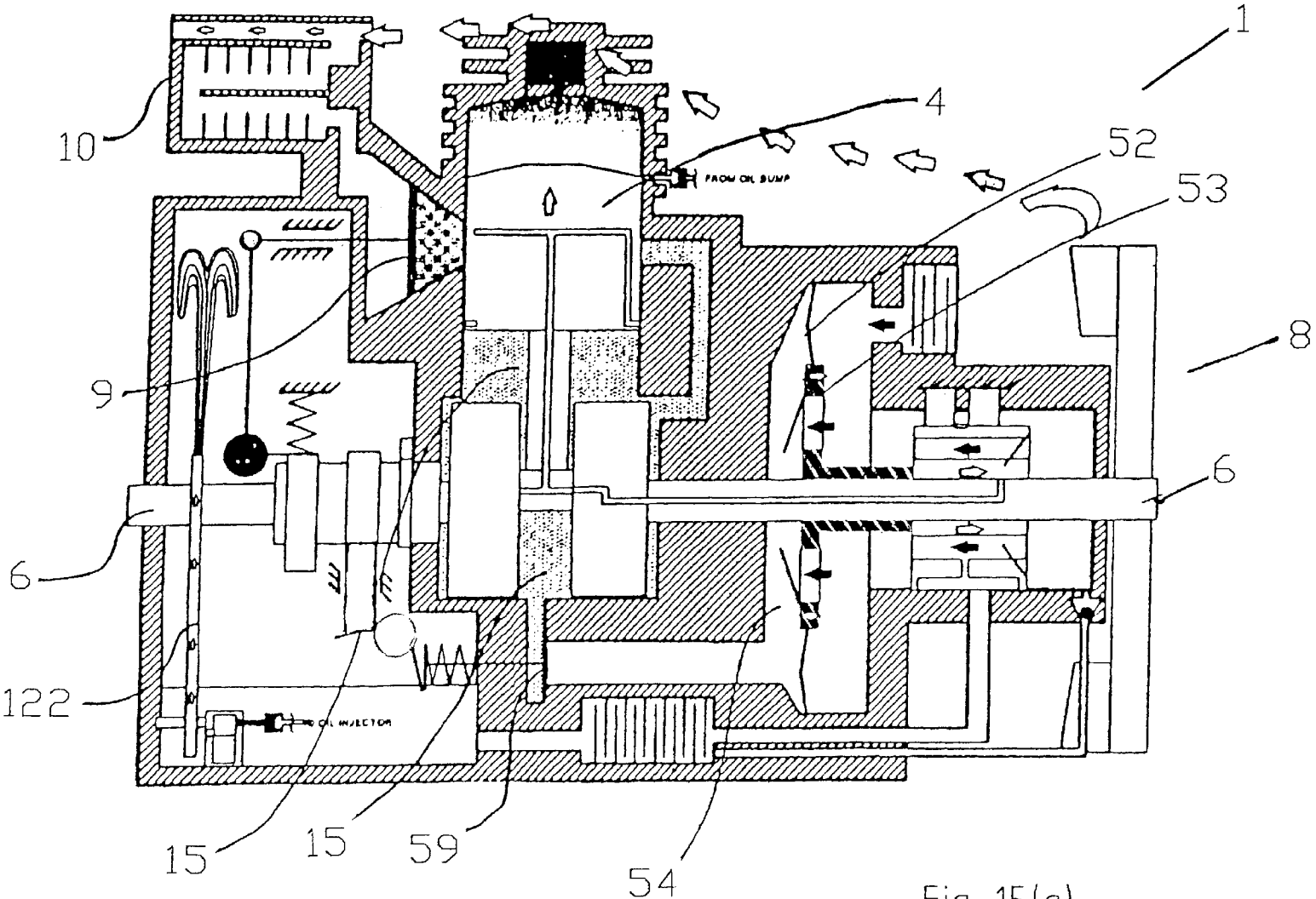

Referring to FIG. 1 and 13, the engine 1 further incorporates a bob weight 99 having a rim 99(*a*) shown in detail in FIG. 12 which is filled with structural foam (not shown) which will be flush with the rim 99(*a*). Structural foam 130 is shown in FIGS. 1 and 2.

Referring to FIG. 1, the cylinder head 3 is a two part cylinder head comprising an inner core 100 having an indirect combustion chamber 101 which inner core 100 is housed within and spaced apart from an outer finned shield 102 and thus there is a space 103 formed between the inner core 100 and the outer shield 102. This space 103 may be filled with any suitable sound absorption material. Any compounds or fluids with good heat transfer properties may be used.

Referring now to FIGS. 1 and 13, there is illustrated the flywheel 11 which includes a plurality of blades 48 for air cooling.

Referring to FIG. 1, there is mounted in the sump 7 and projecting upwardly therefrom, a cylindrical guide 110 which in this embodiment is sealed by a plug 111. As will be described hereinafter with reference to another embodiment of the invention, the cylindrical guide 110 can be used to provide a tap off for power supplies or the like. The advantage of the cylindrical guide 110 is that in the event of any form of seal failure, there will always remain sufficient oil in the sump and this in effect forms a coffer dam.

A pulley 120 is mounted on an idler shaft 121 below the top of the cylindrical guide 110 and below the oil level in the sump which is indicated by the inverted triangle O. The pulley 120 is connected by a toothed belt 122 to a pulley 123 fast on the crankshaft 7. The purpose of the toothed belt 122 is to provide a mist of oil above the oil level O in the sump 7 and thus to lubricate the moving parts such as the rocker arm 97.

The easiest way to understand the operation of the various parts of the engine is to first consider the operation without reference to the particular time in the operating cycle of the engine and then to consider it having regard to the engine cycle.

Firstly, to deal with the operation of the positive displacement supercharger 8, as the supercharger piston 53 moves from left to right under the influence of the cam 70, as seen in FIG. 1, air is compressed in the front delivery chamber 54 and when the valve 59 is opened, air under pressure is delivered into the air charging chamber 15 and can then, if the air transfer port 12 is exposed by the piston 4, be delivered directly into the cylinder 2. In the return or idle stroke, the flap valves 52(*a*) in the piston 53 will open and air will be drawn through the holes 62 and 56 into the front delivery chamber 54. If one presumes that the valve 59 is open for most of the supercharger's working stroke, the supercharger is not in effect working against the engine.

Dealing with the lubricant distribution assembly, essentially the pump 43 delivers oil through the pipe 42 through to the gallery 39 and 38 where it is delivered into the axially arranged groove and from thence to the circumferential groove 21 where it is delivered to the piston skirt 4*a* and thence by the scavenging means as described below, through the galleries 30, 31, 32, 33, 34, and 35 to the gallery 37.

The scavenging means for the lubricant distribution assembly is provided by the supercharger 8 and thus it is necessary to consider the operation again of the supercharger. As the swash plate 75 reciprocates in the crankshaft extension housing 72 when it moves towards the front oil chamber 74 with the cam 70, it generates a vacuum behind it and first exposes the inlet 79 and hence the non return valve 81 so that oil is sucked up through the feed pipe 82 into the rear oil chamber 73. As it progresses further in the working stroke, it eventually exposes the gallery 37 and thus the vacuum is now exerted on all the galleries to draw oil away from the circumferential groove 21. Then on its return journey towards the rear oil chamber 73, oil is delivered through the flap valve 77 into the front oil chamber 74 for lubrication of the cam. Any excess oil is delivered out the outlet 78 through the pipe 80 back into the sump 7 by gravity and/or the action of the swash plate 95 on its next stroke.

It will be appreciated that depending on where the galleries are located, some bearings are not lubricated by the system. It will be noted, for example, in the particular embodiment that the big ends and little ends are lubricated as are some of the other engine bearings.

It is also necessary to consider the operation of the exhaust valve 9 as a separate issue. Essentially, because it is a two-part exhaust valve, if there is excess pressure in the combustion chamber above the piston, the spring 96 will cease to keep the valve head 91 forward in the inner valve guide flange 90 and thus there will be a leak of air past the valve head 91 This will maintain the combustion chamber at the desired combustion pressure until the piston 4 rises to close the exhaust port 13. Thus, the exhaust valve according to the invention ensures a constant compression ratio. Further, when the exhaust valve 9 is opened, because of its configuration in the fully retracted position, the out rushing air from the cylinder 2, at the point of blow down, will be directed across the valve head 91 cooling it. Also, the particular telescopic construction ensures that only a minor portion of the valve is exposed to very high temperature exhaust gases because on retraction, the rest of it is, as it were, under cover.

Referring specifically to FIG. 15(*a*) to (*h*), the operation of the engine is described in more detail. Referring to FIG. 15(*a*), at top dead centre (TDC), ignition has taken place. The valve 59 is closed and the supercharger 8 is isolated from the rest of the engine. Since the piston 4 is in its uppermost position at top dead centre, the maximum vacuum is formed in the air charging chamber 15 below the piston 4. The supercharger 8 is still inducing air through the piston 53 and into the front delivery chamber 54. The supercharger 8 is still inducing air on its return stroke which lags the piston 4 by about 60°.

As the piston 4 descends and referring to FIG. 15(*b*), the supercharger 8 has reached the end of its return stroke and starts to reverse. It will be noted that at this stage, the cam 70 has closed the gallery 37. The flap valves 52(*a*) now close and a positive pressure starts to be generated in the front delivery chamber 54 and a vacuum is now beginning to be generated in the rear oil chamber 73. At the same time, the smash plate 75 is pushing oil in front of it, some of which will be delivered through the return piping 80 to the sump 7. The air is now being compressed by the supercharger 8 as it moves from right to left. Eventually, the gallery 37 is exposed and the vacuum is then exerted on all the galleries between it and the piston 4. Thus, the lubricant distribution assembly is scavenged. The exhaust valve 9 has opened and the piston 4 has not exposed the exhaust port 13. Air is being induced behind the diaphragm 52 into the rear chamber 55.

Referring now to FIG. 15(*c*), the exhaust port 13 is exposed by the piston 4 and exhaust gases are delivered to the muffler 10.

Referring now to FIG. 15(*d*), as the supercharger piston 53 reaches the end of its stroke, the valve 59 opens, the piston 4 and the transfer ports 12 are exposed and scavenging starts to take place. Referring to FIG. 15(*e*), as the piston 4 descends, the gallery 37 is exposed to the rear chamber 73 for scavenging of lubricant.

Generally, the pump 43 will not operate for each cycle of the engine but will simply provide enough oil as required. Depending on the amount of oil being delivered out the gallery 38, it can in fact be a fine mist of oil and air or simply oil which then subsequently becomes a mist when it is scavenged by the vacuum exerted on the circumferential groove 21. The valve 59 closes (see FIG. 15(*f*)) and as the supercharger reverses, the flap valves 52(*a*) stay closed until the pressure is equalised across the piston 53 as shown in FIG. 15(*g*). FIG. 15(*h*) shows ignition.

Figure 16:
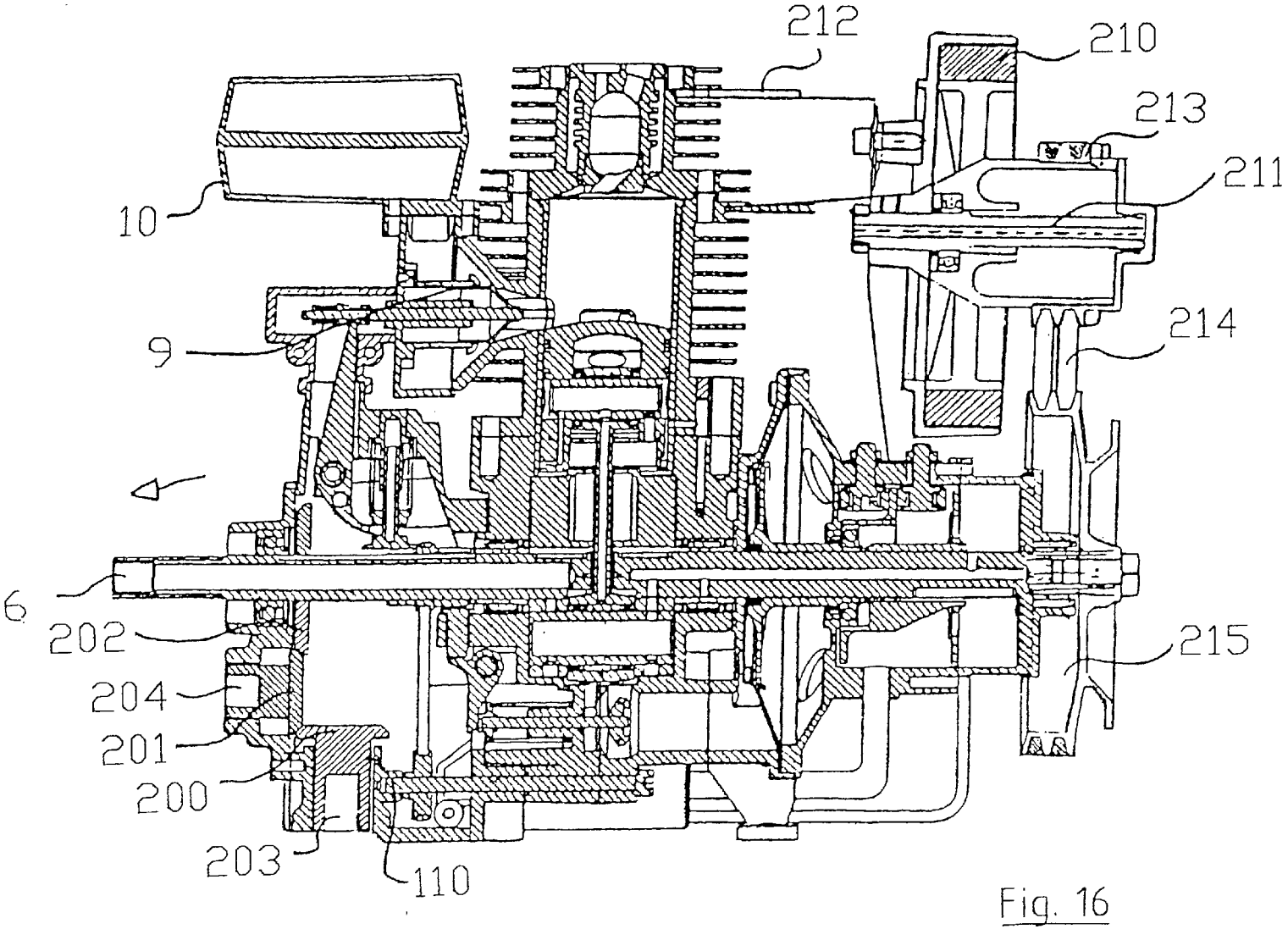
FIG. 16 is a sectional view similar to FIG. 1 of an alternative construction of engine according to the invention.

Referring now to FIG. 16, parts similar to those described with reference to the previous drawings are identified by the same reference numerals and in general, the minimum number of parts are identified to avoid confusion. There is mounted in the sump 7 in the cylindrical guide 110, a bevel gear 200 which forms part of a bevel gear chain and engages another bevel gear 201 which in turn is driven by a further bevel gear 202 on the drive shaft 6. The bevel gears 200 and 201 each have power take off sockets 203 and 204 respectively. Thus, both vertical and horizontal power take off is provided. This is particularly important in that with the lubrication system of the engine, it is not possible to allow the engine to lie totally on its side.

In this embodiment, a flywheel 210 of substantially the same construction as the flywheel illustrated in the previous embodiment except that it is half its weight is mounted by means of a shaft 211 and mounting brackets 212 on the cylinder 2 and is driven by a pulley 213 and V-belts 214 from a further pulley 215 fast on the crankshaft 6.

It is envisaged that the axial groove in the piston may not be required and that instead of having one hole in the cylinder wall injecting oil onto the scraper ring and onto the piston, that a plurality of circumferentially spaced-apart holes may be used. It is also envisaged that an indirect cylinder may not be necessarily required because of the very low speeds at which the engine is operating.

It will be appreciated that the essential feature of the lubrication distribution assembly which forms part of this invention is the delivery of oil from the storage sump with some means for injecting or delivering the oil between the piston and the cylinder walls at discrete time intervals and then some scavenging means for removing the oil from the piston and cylinder wall and returning excess oil to the sump through some form of lubricant galleries. It is essentially a pressurised oil delivery followed by a vacuum type scavenging. Ideally, the pressurised oil delivery is achieved at regular timed intervals and this delivery of oil should be in some way proportionate to piston speed. A typical system that could be used would be any form of gear pulley reduced positive displacement pump. An oil pressure accumulator incorporating a pressure release valve which would be preset to inject a measured amount of oil at regular time intervals would also be suitable. Indeed, it is envisaged that the oil supply for a such a system could be by means of the supercharger oiling chamber or indeed any other suitable means. For example, if electrical power is provided, then a solenoid actuated pump could be timed to inject oil at regular time intervals. Equally adequate would be an accumulator with a solenoid valve in the place of a pressure release valve. It will be appreciated that instead of using the supercharger to provide the vacuum as described above, the one pump arrangement could, as well as providing a positive displacement of oil or injection of oil into the engine could also scavenge the engine by exerting a vacuum on the galleries.

One of the major advantages of a positive displacement supercharger and in particular a positive displacement diaphragm supercharger is that you can hold the cylinder head pressure constant. A further advantage is that there is relatively little drag or wasted work. Since the valve opens at bottom dead centre and still has about 60% of the supercharger working stroke to be completed, the supercharger does not waste very much energy in the sense that it is not working against a valve such as, for example, in the prior art where there is considerable resistance to the supercharger in the sense that it is working against itself. Generally speaking, the supercharger lags the piston by about 60°.

In the normal two stroke engine, as it ascends, it sucks in atmospheric air and then when it descends, it compresses that air. In the present invention, the exhaust stroke is completed by the time the supercharger inlet valve is open.

The supercharger probably can have 2 to 3° advance without loss at bottom dead centre due to the fact that the air will take some time to travel up to the exhaust valve. Thus, the exhaust valve can close somewhat later. One of the great advantages of the present invention is that with slow revving engines, one has in effect a much higher area of transfer port in that the transfer port is left open much longer. At bottom dead centre, when the supercharger opens, the pressure is approximately two atmospheres, that is to say, one bar above gauge.

When the supercharger piston is on the return stroke the resident pressure in the chamber between the supercharger valve (now closed) and the diaphragm assists in returning the supercharger assembly, thereby easing the stress on the system. Since the supercharger inlet valve closes to coincide with the return stroke of the supercharger, there is no drawback of air from the crankcase. Therefore, the crankcase retains the pressure from the previous charge which amounts to an additional atmosphere over and above a conventional two-stroke engine (which has to draw a fresh charge by the vacuum created under the piston for each upward stroke). There are two main advantages of this feature. Firstly, as the supercharger inlet valve remains closed for the duration of the power stroke, the pressure in the crankcase for blowdown is not doubled when compared with conventional two-stroke engines thereby increasing the cylinder purity with a resultant increase in power as there is more available oxygen for combustion. Secondly, there is a positive pressure in the crankcase at all times which assists the distribution of oil to the undersides of the gudgeon pin, big end and main bearings thereby reducing wear— in a convention two-stroke engine, the load always acts in the same direction thereby reducing the distribution of oil to the underside of the bearings which results in increased wear.

The situation of single cylinder engines is difficult because of residual pressure in the manifolds. To get a high efficiency slow revving engine is difficult. At high speed engines, the area of the ports needs to be tuned because you have much less time to pass the port with the piston and therefore effectively, the piston area is greatly reduced for example 10,000 revs as against 1,000 revs means that you have one tenth the time and therefore you need much bigger ports. The present invention can allow the use of much smaller ports which is advantageous. The present invention is putting twice the air and fuel into the engine. There is increased oxygen by about 22% above the normal so that many other useful combustion techniques such as swirl, later injection, retarding and so on can be used while arriving at the optimum combustion.

As explained above, it is envisaged that the lubrication system may utilise other moving engine parts to effectively form a pump. Ideally, the lubrication system according to the present invention may be used for other bearings and can indeed be used for the oiling of ancillary equipment.

A further advantage of the lubrication system is that it is possible to dispense with hydrostatic bearings in the engine which reduces the drag in the engine. An engine using the lubrication system according to the present invention can use frictionless bearings, which are much better for reduction of drag. While noise may be increased, other means may be provided to reduce this noise and in any case the noise produced is not significant.

A particular advantage of the system is that if an engine is manufactured using the system, the oil is stored in a sealed environment, without dilution and it travels a defined course. This excludes contamination with normal dirt, dust etc. so it is envisaged the engine life and quality will be greatly enhanced.

One of the problems in conventional two stroke engines is that all the bearings are open. This can lead to particularly serious problems in adverse enviromental conditions, such as, for example, a salty environment that marine engines encounter. Bearings are usually sensitive to salt which causes corrosion, however, frictionless bearings require no pressurised oiling system, which ensures a longer life. With frictionless bearings it is possible to lubricate the bearings with something of the order of 2% by volume of oil in the air mixture or mist. The advantage of only requiring this very small volume of oil in the air mix is that this can be achieved without requiring too much power. Indeed, it is important not to over-oil frictionless bearings.

A further point that must be appreciated is that in the normal two stroke engine the oil is being diluted with fuel so that you are in effect degrading it. However, in the present invention there is no question of diluting the oil by mixing it with fuel, but simply entraining it or carrying it in the air to the specific part such as the piston, the cylinder or a bearing so that the lubricant deposited on the part is a high grade undiluted lubricant. This means that the optimum grade of lubricant can be chosen without any question of considering the effects of dilution by the fuel.

Another advantage of the relatively small volume of oil entrained in air being delivered around the system is that the pressure differential across the system is necessarily small.

It is envisaged that the pumping could be effected by one of the parts of the engine, namely the cam of the supercharger operating almost like a swash-plate pump. Thus the supercharger could achieve a dual action.

A further advantage with the lubrication system according to the invention is that when a groove is cut in the piston for the lubricant, there is an added cooling of the piston where it is most required. Therefore the oil/air mist acts as a coolant and an additional advantage is that when the piston is at its hottest, there is maximum lubricant being transmitted to it. When the lubrication system is shut-off during its cycle sufficient lubricant mist is entrained in the groove.

A particular advantage will be appreciated in relation to two stroke engines in that when in conventional engines on idle conditions the throttle is closed down, there is no oil/air fuel mixture being delivered to the engine and thus the engine is not being lubricated. However, with the present invention the engine is always being lubricated once the piston is moving.

It is envisaged that by using a vacuum system there will always be a draw-off of the oil/air mist lubricant from the parts and this will ensure that in contrast to more conventional pressurised systems, there will not be over-oiling. It is envisaged that probably a difference of pressure of the order of 0.3 bar (5 psi approx) is all that is required.

Finally, the present lubrication system is not alone a more efficient lubrication system than has heretofore been provided and particularly for two stroke engines, but the concept of segregating an oil/air mist or mixture for lubrication in preference to the oil/fuel mixture used in conventional two stroke engines is such that it will provide an ecologically clean exhaust meeting forthcoming stringent emission legislations.

While under-pumping air charging without supercharging will work and will give many advantages, it is particularly advantageous to use a combination of both supercharging and air charging. The advantage of the dual function is that the under-pumped air may be used for exhaust scavenging down to bottom dead centre and when used in conjunction with an exhaust valve, the exhaust valve is closed and the supercharger inlet valve may open. The charge of air behind the inlet valve and in the supercharger is a pre-compressed supercharger air which is delivered into the cylinder and crankcase via the transfer ports. The supercharger can then operate until the air transfer ports are closed by the piston skirt or crown.

While it is envisaged that superchargers other than positive displacement superchargers may be used, there are practical advantages in using a positive displacement supercharger. Most superchargers are relatively expensive to produce, with the exception of the sliding vane types and all of them, with the exception of the centrifugal types which are unsuitable, require lubrication and thus one of the advantages of using a positive displacement supercharger of the type envisaged above is that there is no oil entrained in the air stream and thus pollution is held to a lower level than it would be if lubricated superchargers were used which of necessity will cause pollution.

The isolation of the sump is particularly advantageous when the lubrication system as described above is used.

An exhaust valve is essential for the efficient operation of the invention with the supercharger.

A particular advantage of the positive displacement supercharger is that_lower speeds can be used. Lower speeds are particularly advantageous when a diaphragm is used and as mentioned above a particular advantage of the diaphragm type of supercharger is that it doesn't need lubrication.

One of the advantages of having an exhaust valve which is pressure-released or indeed any other pressure release means is that it is now possible to maintain a consistent pressure above the piston in the cylinder which will ensure that the pneumatic Rynhart injector will operate efficiently at injection point.

It is important to appreciate that such a pneumatic injector will not work satisfactorily with a supercharger, unless some form of pressure control is adopted. Obviously without a supercharger there is no need for this pressure control as always the same constant volume of air will be trapped within the cylinder.

A further advantage of the use of a supercharger in the system is that with a positive displacement supercharger and valve, no supercharged air is being lost and therefore there is a reduction in the power input to the supercharger.

What is important to appreciate is that the combination of under-pumping and supercharger according to the present invention creates an environment for a much cleaner burning engine than heretofore, because of the surplus air being delivered to the cylinder.

One of the main problems with a conventional two stroke engine is that while the piston is descending approximately 25% of the swept volume is being blown out and something of the order of 40% of the fuel/oil/air mixture which is unburnt is blown out the exhaust. This is one of the reasons why two stroke engines are so fuel inefficient and so environmentally unfriendly.

By trapping the charge and enhancing it with a supercharger, the present invention is not only exceeding the efficiency of four stroke engines, but it will produce nearly double the output for the same revs. It was also found that the selective delivery of the supercharger is particularly suitable for controlling the engine. This means that for only half the time is the supercharger working and this is the only time that is required. Supercharger power input requirements are much less than with conventional systems.

One of the great advantages is that with the present invention a relatively low speed engine with high power to weight ratio can be achieved relative to a four stroke engine of effectively the same swept volume.

There are certain major advantages having a flywheel rotating at double the speed of the shaft to which it is connected. Firstly, it reduces the overall weight of the engine and secondly in the remote event of failure, the flywheel being driven out or from an engine it will be less dangerous than one of double its size. A further advantage is that it can be so designed as to ensure that on engine failure the drive to it will shear before the flywheel comes off its own shaft to cause damage.

The advantage of having a fan incorporated into the flywheel is that direct cooling of the cylinder and cylinder head may be provided.

By using an exhaust valve with a two stroke engine it obviates the necessity to use some form of tuned exhaust to utilise the dynamic affect of the out-rushing gases.

The present invention makes it much easier to trap the charge and accordingly a simpler construction of silencer may be used this in turn leads to a reduction in weight and more efficient exhaust handling.

The exhaust valve and seating in the exhaust port may be so configured as to be shut by either a pushing or pulling force. The former has the advantage of a reduced load on the cam and requires a spring with a less high rate than for a pushing force. It will be appreciated that an exhaust valve pushed shut is always acting against cylinder pressure. At the same time a pulling force operated valve as in the majority of engines has more complex geometry, less aerodynamically correct profile and finally greater dead space volume around the port.

One of the advantages of using structural foam is that it is possible to achieve higher than normal crankcase compression because the dead volume has been reduced, this also helps where a supercharger is being used as you don't have to have as big a supercharger as you would expect in that you are cutting down the crankcase volume. This similarly helps with under-pumping. In essence, by using structural foam the volumes are reduced and a higher transfer compression can be achieved than in a normal engine.

Polyurethane is a particularly suitable material in that it is impervious to diesel, petrol, oil and can withstand temperatures far in excess of any heat normally experienced in a crankcase. A further advantage in the use of polyurethane is it may be simply applied and may be relatively easily moulded in position. A further advantage of polyurethane is that its density can be varied and a hard durable surface can be achieved with a closed cellular internal surface.

The advantage of using the Rynhart injector rather than a conventional pump and injector is that if a conventional pumping injector is used in an indirect chamber, some means for producing in-cylinder swirl is necessary to facilitate and assist combustion.

It is important to appreciate that with an indirect combustion chamber and a construction such as described above, namely, a two-part cylinder head there could be a reduction in combustion knock.

The great advantage of the use of the Rynhart pneumatic injector is that a conventional injector with an indirect chamber operating on two stroke operation would probably be relatively inefficient because of the amount of pollutants that would be retained within the indirect combustion chamber. However, the Rynhart injector releases a charge of air down into the combustion chamber which facilitates the scavenging of the indirect combustion chamber at the point of exhausting the main charge from the cylinder.

What has to be appreciated is that while the various features of the invention disclosed in this specification may be separated into a series of inventions, it is important to realise that it is not just simply a new lubrication system or particular form of combustion chamber flywheel or supercharger designed in isolation, but they all together contribute to an overall concept of weight-saving and an environmentally efficient engine and in particular allows two stroke engines to approach the output of four stroke engines at substantially the same power weight ratios in a particular range.

Indeed prototypes have already been produced which show that a two stroke diesel engine in the power range of the order of 6 horsepower would have the same output and weight as a corresponding four stroke petrol engine. To achieve this with a two stroke diesel engine is particular advantageous. This is particularly the case for example for the small marine outboard engines, motor-mower engines and auxiliary engine markets, particularly where constant running is required. A classic example of this would be for power generation. When it is considered that in the marine leisure market alone, there are almost 13 million engines sold every year, the advantage of having a diesel two stroke, rather than a petrol engine with its consequent safety and durability features is an overwhelming argument in favour of the advantages of the present invention.

One of the major advantages of the present invention is in relation to the use of petrol for starting. Diesel engines are notoriously difficult to start in temperatures below freezing point and most diesel fuels will, "wax" at temperatures as high as 8° C. The present invention though primarily designed to run on diesel at a compression ratio of up to 18:1 may have the compression ratio dropped relatively easily to, for example, 9:1 which would allow for initial starting on petrol, thereby reducing the starting effort.

Ideally the clearance volume of the cylinder will be so calculated as to equate to the 18:1 compression ratio when taking account the additional 100% increase in mass density which will be achieved using a supercharger and thus when the supercharger is effectively short-circuited the compression ratio drops to the desired compression ratio for petrol start-up.

It will also be appreciated that diesel start-up can still be effected by reducing the compression ratio in normal ambient temperatures without using petrol. The great advantage of petrol start-up is that it allows start-up at temperatures as low as −30° C. and when employed at these temperatures it is envisaged that the engine could run on diesel long enough to "de-wax" the diesel fuel in the tank pump and injector. At this stage the petrol supply can be cut-off and the ignition system run on diesel at the correct ratio.

It must again be appreciated that a major achievement of the present invention is in providing an advanced and sophisticated two stroke engine which can be manufactured at low cost and will produce in the order of 6 to 10 horsepower. One of the objectives is to replace the four stroke engine with a slow revving and thus durable two stroke diesel engine. One particular prototype already manufactured according to the invention is a two stroke diesel engine of a weight of the order of 22 kg (48 lbs) and is expected to produce at least 6 horsepower. A conventional 6 horsepower compression ignition diesel engine normally has a weight somewhat of the order of 2 to 3 times this. An engine of this weight is suitable for use as an outboard for marine use or for a heavy duty grass mower. Thus, the invention has achieved the power to weight ratio equivalent of the four stroke petrol engine with the added longevity of a slow action engine. The use of diesel is obviously more advantageous than petrol.

What is claimed is:

1. An internal combustion engine comprising:

a piston having a crown and skirt housed within a cylinder block in a cylinder bore;

the piston connected by a connecting rod to a crankshaft, said connecting rod having respective little and big ends, the piston reciprocating between bottom dead centre (BDC) and top dead centre (TDC), within the cylinder bore;

engine bearings for the crankshaft, little and big ends;

an air transfer port in the cylinder bore;

an exhaust port in the cylinder bore connected to an exhaust pipe;

an oil storage sump;

a crankcase housing the connecting rod and portion of the crankshaft;

an air charging chamber formed by portion of the cylinder bore and the crankcase;

an air inlet duct for delivery of air to the charging chamber;

air transfer ducting between the charging chamber and the air transfer port;

a positive displacement supercharger housing mounted outside the air charging chamber;

a diaphragm in the housing dividing the housing into a front delivery chamber communicating via an outlet with the air inlet duct and a rear chamber open to the atmosphere;

means for moving the diaphragm across the chamber towards the outlet in a working stroke delivering air to the engine and away from the outlet in a return stroke drawing air into the housing; and a one way valve mounted with the diaphragm to only allow passage of air between the rear and front chambers during the return stroke of the diaphragm away from the outlet.

2. An internal combustion engine as claimed in claim 1, in which the diaphragm is supported on a piston, the diaphragm comprising:

a plate having a hole for slidably mounting on the crankshaft, the one way valve is mounted on the plate; and a cam assembly is provided for reciprocating the piston on the crankshaft, the cam assembly comprising a cam connected to the piston and a rigidly mounted cam follower.

3. An internal combustion engine as claimed in claim 2, in which the cam assembly comprises:

a crankshaft extension housing having a rear oil chamber remote from the diaphragm and a front oil chamber closer to the diaphragm;

a rotatable swash plate on the crankshaft connected to the cam and mounted in the crankshaft extension housing for reciprocation therein on the crankshaft;

a one-way valve mounted in the swash plate;

return piping connecting the front oil chamber to the oil storage sump;

feed piping connecting the oil storage sump to the rear oil chamber;

a non-return valve mounted in the feed piping; and a lubricant gallery to the crankshaft having an inlet in the crankshaft between where the return piping connects to the front oil chamber and where the feed piping connects to the rear oil chamber and within the portion of the crankshaft over which the swash plate reciprocates;

whereby as the swash plate reciprocates in the rear oil chamber towards the front oil chamber with the cam it generates a vacuum and first exposes the non-return valve in the feed piping to the sump to draw oil into the rear oil chamber and as the swash plate progresses further a vacuum builds up in the rear oil chamber until the inlet to the gallery is exposed and the vacuum is exerted on the galleries to draw oil into the rear oil chamber and on the swash plate reversing oil is delivered through the one way valve in the swash plate to the front oil chamber for lubrication of the cam and delivery to the sump through the return piping.

4. An internal combustion engine as claimed in claim 1, in which there is a timed delivery valve in the air inlet duct.

5. An internal combustion engine as claimed in claim 4, in which there is a timed delivery valve in the air inlet duct and the timed delivery valve comprises means to open said valve at approximately BDC and means to close it after the air transfer port is closed by the rising crown and skirt of the piston.

6. An internal combustion engine as claimed in claim 1, in which there is a timed delivery valve in the air inlet duct and the timed delivery valve comprises means to keep the said valve open during a substantial portion of the superchargers working stroke.

7. An internal combustion engine as claimed in claim 1, in which inserts are provided in the crankcase and on portions of the engine housed therein to reduce the volume of the charging chamber.

8. An internal combustion engine as claimed in claim 7, in which the inserts are formed from a structural foamed plastics material.

9. An internal combustion engine as claimed in claim 7, in which the inserts are formed from foamed polyurethane.

10. An internal combustion engine as claimed in claim 1, in which there is provided a generally cylindrical bob weight for the connecting rod filled with inserts to reduce the volume of the charging chamber.

11. An internal combustion engine as claimed in claim 10, in which the inserts are formed from a structural foamed plastics material.

12. An internal combustion engine as claimed in claim 10, in which the inserts are formed from foamed polyurethane.

13. An internal combustion engine as claimed in claim 1, in which there is provided a lubricant distribution assembly comprising:

means for delivery of oil from the oil storage sump;

means for injecting oil between the piston skirt and cylinder wall at discrete time intervals; and scavenging means for removing oil from the piston skirt and cylinder wall and returning excess oil to the sump through lubricant galleries comprising enclosed passageways.

14. An internal combustion engine as claimed in claim 13, in which the galleries communicate through the piston and connecting rod to the sump.

15. An internal combustion engine as claimed in claim 13, in which the means for injecting oil between the piston skirt and cylinder walls comprises a circumferential groove in the piston skirt and a hole in the cylinder wall connected by galleries to an oil pump for delivering oil from the storage sump.

16. An internal combustion engine as claimed in claim 15, in which there is provided a plurality of circumferentially spaced holes around the cylinder wall.

17. An internal combustion engine as claimed in claim 15, in which there is an additional elongated axially arranged groove in the piston skirt communicating with the hole in the cylinder wall and with the circumferential groove.

18. An internal combustion engine as claimed in claim 15, in which the circumferential groove incorporates an oil scavenging ring.

19. An internal combustion engine as claimed in claim 15, in which the circumferential groove is adjacent the bottom of the piston skirt.

20. An internal combustion engine as claimed in claim 15, in which galleries comprising enclosed passageways communicate with the circumferential groove for scavenging.

21. An internal combustion engine as claimed in claim 15, in which galleries comprising enclosed passageways connect the piston and the oil storage sump via at least one of the engine bearings for lubrication thereof.

22. An internal combustion engine as claimed in claim 13, in which the scavenging means includes means for forming an oil/air mist as the oil is drawn from the piston.

23. An internal combustion engine as claimed in claim 13, in which the lubricant distribution assembly incorporates a positive displacement pump.

24. An internal combustion engine as claimed in claim 13, in which the lubricant assembly incorporates an oil pressure relief valve.

25. An internal combustion engine as claimed in claim 13, in which the scavenging means comprises means for causing a vacuum to be exerted in the gallery.

26. An internal combustion engine as claimed in claim 25, in which the supercharger forms the vacuum.

27. An internal combustion engine as claimed in claim 1, in which there is provided a two part exhaust valve comprising an outer exhaust port seating portion and a main inner portion, the outer and inner portions being mutually engagable to retract away from the exhaust port.

28. An internal combustion engine as claimed in claim 1, in which there is provided a two-part telescopic exhaust valve comprising an exhaust port seating mushroom valve head mounted on a valve stem and having a rearwardly extending tubular portion nesting and slidable within an enclosed tubular stationary bushed guide through which the valve stem projects.

29. An internal combustion engine as claimed in claim 28, wherein the valve stem engages one end of a valve rocker arm, the other end of which is spring urged into engagement with a cam on the crankshaft.

30. An internal combustion engine as claimed in claim 1, in which the cylinder head is a two-part cylinder head comprising an inner portion housed within a concentric outer portion, the portions forming a hollow circumferential chamber therebetween and a sound absorption material in the chamber.

31. An internal combustion engine as claimed in claim 30, wherein the sound absorption material is additionally an efficient heat transfer material.

32. An internal combustion engine as claimed in claim 1, in which there is provided a flywheel driven from the crankshaft at a speed twice that of the crankshaft.

33. An internal combustion engine as claimed in claim 32, wherein the flywheel is mounted on a shaft offset from the crankshaft.

34. An internal combustion engine as claimed in claim 1, in which the internal combustion engine is a two-stroke compression ignition engine.

35. An internal combustion engine as claimed in claim 1, in which the internal combustion engine is a single cylinder engine.

36. An internal combustion engine of the type comprising:

a piston housed within a cylinder block in a cylinder bore;

the piston connected by a connecting rod to a crankshaft, said connecting rod having respective little and big ends with the piston reciprocating between bottom dead centre (BDC) and top dead centre (TDC), within the cylinder bore;

engine bearings for the crankshaft little and big ends;

the piston having spaced-apart upper and lower piston rings in the piston skirt;

an exhaust port in the cylinder bore connected to an exhaust pipe;

an oil storage sump;

means for delivery of oil from the oil storage sump;

means for injecting oil between the piston skirt and cylinder wall at discrete time intervals; and scavenging means for removing oil from the piston and cylinder wall and returning excess oil to the sump through galleries forming, with the means for delivery of oil and the means for injecting oil, a lubricant distribution assembly.

37. An internal combustion engine as claimed in claim 36, in which the galleries communicate through the piston and connecting rod to the sump.

38. An internal combustion engine as claimed in claim 36, in which the means for injecting oil between the piston skirt and cylinder walls comprises a circumferential groove in the piston skirt and a hole in the cylinder wall connected by galleries to an oil pump for delivering oil from the storage sump.

39. An internal combustion engine as claimed in claim 38, in which there is provided a plurality of circumferentially spaced holes around the cylinder wall.

40. An internal combustion engine as claimed in claim 38, in which there is an additional elongated axially arranged groove in the piston skirt communicating with the hole in the cylinder wall and with the circumferential groove.

41. An internal combustion engine as claimed in claim 38, in which the circumferential groove incorporates an oil scavenging ring.

42. An internal combustion engine as claimed in claim 38, in which the circumferential groove is adjacent the bottom of the piston skirt.

43. An internal combustion engine as claimed in claim 38, in which the galleries comprising enclosed passageways communicate with the groove.

44. An internal combustion engine as claimed in claim 38, in which galleries comprising enclosed passageways connect the piston and the oil storage sump via at least one of the engine bearings for lubrication thereof.

45. An internal combustion engine as claimed in claim 38, in which the scavenging means includes means for forming an oil/air mist as the oil is drawn from the piston.

46. An internal combustion engine as claimed in claim 38, in which the lubricant distribution assembly incorporates a positive displacement pump.

47. An internal combustion engine as claimed in claim 38, in which the lubricant distribution assembly incorporates an oil pressure relief valve.

48. An internal combustion engine as claimed in claim 38, in which scavenging means comprises means for causing a vacuum to be applied to some or all of the galleries.

49. An internal combustion engine as claimed in claim 48, in which the supercharger comprises the scavenging means by forming the vacuum.

50. An internal combustion engine as claimed in claim 48, in which the cam assembly comprises:

a crankshaft extension housing having a rear oil chamber remote from the diaphragm and a front oil chamber closer to the diaphragm;

a rotatable swash plate on the crankshaft connected to the cam and mounted in the crankshaft extension housing for reciprocation therein on the crankshaft;

a one-way valve mounted in the swash plate;

return piping connecting the front oil chamber to the oil storage sump;

feed piping connecting the oil storage sump to the rear oil chamber;

a non-return valve mounted in the feed piping; and a lubricant gallery to the crankshaft having an inlet in the crankshaft between where the return piping connects to the front oil chamber and where the feed piping connects to the rear oil chamber and within the portion of the crankshaft over which the swash plate reciprocates;

whereby as the swash plate reciprocates whereby as the swash plate reciprocates in the rear oil chamber towards the front oil chamber with the cam it generates a vacuum and first exposes the non-return valve in the feed piping to the sump to draw oil into the rear portion and as the piston progresses further a vacuum builds up in the rear oil chamber until the gallery is exposed and the vacuum is exerted on the galleries to draw oil into the rear oil chamber and on the swash plate reversing oil is delivered through the one-way valve in the swash plate to the front oil chamber for lubrication of the cam and delivery to the sump through the return piping.

51. An internal combustion engine as claimed in claim 36, comprising:

a crankcase housing the connecting rod and portion of the crankshaft;

an air charging chamber formed by portion of the cylinder bore and the crankcase;

an air inlet duct for delivery of air to the charging chamber;

an air transfer port in the cylinder bore;

air transfer ducting between the charging chamber and the air transfer port; and a positive displacement supercharger connected to the air inlet duct, the positive displacement supercharger having a working stroke delivering air to the engine and a return stroke drawing air into the supercharger.

52. An internal combustion engine as claimed in claim 51, in which the supercharger comprises:

a positive displacement supercharger housing mounted outside the air charging chamber;

a diaphragm in the housing dividing the housing into a front delivery chamber communicating via an outlet with the air inlet duct and a rear chamber open to the atmosphere; and means for moving the diaphragm across the chamber towards the outlet in a working stroke delivering air to the engine and away from the outlet in a return stroke drawing air into the housing.

53. An internal combustion engine as claimed in claim 51, in which the diaphragm is supported on a piston, the diaphragm comprising:

a plate having a hole for slidably mounting on the crankshaft, the one way valve is mounted on the plate; and a cam assembly is provided for reciprocating the piston on the crankshaft, the cam assembly comprising a cam connected to the piston and a rigidly mounted cam follower.

54. An internal combustion engine as claimed in claim 51, in which there is a timed delivery valve in the air inlet duct.

55. An internal combustion engine as claimed in claim 51, there is a timed delivery valve in the air inlet duct and the timed delivery valve comprises means to keep the said valve open during a substantial portion of the superchargers working stroke.

56. An internal combustion engine as claimed in claim 51, in which there is a timed delivery valve in the air inlet duct and the timed delivery valve comprises means to open said valve at approximately BDC and means to close it after the air transfer port is closed by the rising crown and skirt of the piston.

57. An internal combustion engine as claimed in claim 51, in which inserts are provided in the crankcase and on the portions of the engine housed therein to reduce the volume of the charging chamber.

58. An internal combustion engine as claimed in claim 57, in which the inserts are formed from a structural foamed plastics material.

59. An internal combustion engine as claimed in claim 57, in which the inserts are formed from foamed polyurethane.

60. An internal combustion engine as claimed in claim 51, in which there is provided a generally cylindrical bob weight for the connecting rod filled with inserts to reduce the volume of the charging cylinder.

61. An internal combustion engine as claimed in claim 60, in which the inserts are formed from a structural foamed plastics material.

62. An internal combustion engine as claimed in claim 60, in which the inserts are formed from foamed polyurethane.

63. An internal combustion engine as claimed in claim 51, in which there is provided a two part exhaust valve having an outer exhausting port seating portion and a main inner portion, the outer and inner portions being mutually engagable to retract away from the exhaust port.

64. An internal combustion engine as claimed in claim 51, in which there is provided a two-part telescopic exhaust valve comprising an exhaust port seating mushroom valve head mounting on a valve stem and having a rearwardly extending tubular portion nesting and slidable within an enclosed tubular stationary bushed guide through which the valve stem projects.

65. An internal combustion engine as claimed in claim 64, wherein the valve stem engages one end of a valve rocker arm, the other end of which is spring urged into engagement with a cam on the crankshaft.

66. An internal combustion engine as claimed in claim 51, in which the cylinder head is a two-part cylinder head comprising an inner portion housed within a concentric outer portion, the portions forming a hollow circumferential chamber therebetween and a sound absorption material in the chamber.

67. An internal combustion engine as claimed in claim 66, wherein the sound absorption material is additionally an efficient heat transfer material.

68. An internal combustion engine as claimed in claim 51, in which there is provided a flywheel driven from the crankshaft at a speed twice that of the crankshaft.

69. An internal combustion engine as claimed in claim 68, wherein the flywheel is mounted on a shaft offset from the crankshaft.

70. An internal combustion engine as claimed in claim 36, in which the internal combustion engine is a two-stroke compression ignition engine.

71. An internal combustion engine as claimed in claim 36, in which the internal combustion engine is a single cylinder engine.

72. A supercharged internal combustion engine comprising a positive displacement supercharger having a working stroke for delivering air to the engine combustion chamber and a return stroke drawing air through an air inlet into the supercharger, in which the supercharger comprises:

a supercharger housing;

a diaphragm dividing the housing into a front delivery chamber communicating via an outlet with the air inlet duct and a rear chamber open to the atmosphere;

means for moving the diaphragm across the chamber towards the outlet in a working stroke and away from the outlet in a return stroke drawing air into the housing; and a one way valve mounted with the diaphragm to only allow passage of air between the rear and front chambers during the return stroke of the diaphragm away from the outlet.

73. A supercharged internal combustion engine as claimed in claim 72, in which the diaphragm is supported on a piston, the diaphragm comprising:

a plate having a hole for slidably mounting on the crankshaft;

the one way valve is mounted on the plate; and a cam assembly is provided for reciprocating the piston on the crankshaft, the cam assembly comprising a cam connected to the piston and a rigidly mounted cam follower.

74. A supercharged internal combustion engine as claimed in claim 73, in which the supercharger feeds the engine indirectly through an accumulator chamber having an outlet valve so as to deliver a pulsed charge of air to the combustion chamber.

75. A supercharged internal combustion engine as claimed in claim 74, in which the outlet valve is pressure controlled.

76. A supercharged internal combustion engine as claimed in claim 74, in which the operation of the outlet valve is synchronized with the engine cycle.

77. A supercharged internal combustion engine as claimed in claim 72, in which the supercharger feeds the engine indirectly through an accumulator chamber having an outlet valve so as to deliver a pulsed charge of air to the combustion chamber.

78. A supercharged internal combustion engine as claimed in claim 77, in which the outlet valve is pressure controlled.

79. A supercharged internal combustion engine as claimed in claim 77, in which the operation of the outlet valve is synchronised with the engine cycle.

* * * * *